US010824089B2

(12) United States Patent
Ishidate et al.

(10) Patent No.: US 10,824,089 B2
(45) Date of Patent: Nov. 3, 2020

(54) IMAGE FORMING APPARATUS INCLUDING A MOVING MECHANISM FOR AN OPTICAL PRINT HEAD

(71) Applicant: CANON KABUSHIKI KAISHA, Tokyo (JP)

(72) Inventors: Takehiro Ishidate, Tokyo (JP); Hitoshi Iwai, Abiko (JP); Yuya Tamura, Tsukuba (JP); Toshiki Momoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/713,891

(22) Filed: Dec. 13, 2019

(65) Prior Publication Data

US 2020/0117115 A1 Apr. 16, 2020

Related U.S. Application Data

(63) Continuation of application No. PCT/JP2018/023717, filed on Jun. 15, 2018.

(30) Foreign Application Priority Data

Jun. 16, 2017 (JP) ..... 2017-118998

(51) Int. Cl.
*G03G 15/04* (2006.01)

(52) U.S. Cl.
CPC ..... *G03G 15/04036* (2013.01)

(58) Field of Classification Search
USPC ..... 399/4
See application file for complete search history.

(56) References Cited

U.S. PATENT DOCUMENTS

2013/0164027 A1* 6/2013 Sato ..... G03G 21/1633 399/110
2013/0194369 A1 8/2013 Shimamoto
2015/0043939 A1 2/2015 Lee

FOREIGN PATENT DOCUMENTS

JP 07302007 A 11/1995
JP 2000293085 A 10/2000
JP 2013134370 A 7/2013
JP 2013156320 A 8/2013

OTHER PUBLICATIONS

International Search Report issued in corresponding International Application No. PCT/JP2018/023717 dated Aug. 28, 2018.

* cited by examiner

*Primary Examiner* — Quana Grainger
(74) *Attorney, Agent, or Firm* — Venable LLP

(57) ABSTRACT

In an image forming apparatus, a cover 558 rotates from an open position to a closed position, so that an urging portion 561 urges a first portion-to-be-urged 566, and a slidable portion 525 moves from a rear side toward a front side. By this, an optical print head 105 moves from a retracted position toward an exposure position. Thereafter, when the cover 558 further rotates, the urging portion 561 moves from the first portion-to-be-urged 566 onto a second portion-to-be-urged 567 and moves on the second portion-to-be-urged 567. By this, the slidable portion 525 and link portions 651-654 are kept in a rest state without being moved with rotation of the cover 558.

20 Claims, 23 Drawing Sheets

REAR TOWARD FRONT ON DRAWING SHEET : FRONT
FRONT TOWARD REAR ON DRAWING SHEET : REAR (a)

(b)

(a)

(b)

(a)

(b)

(a)

(b)

(a)

(b)

(a)

(b)

(c)

(a)

(b)

(a)

(b)

IMAGE FORMING APPARATUS INCLUDING A MOVING MECHANISM FOR AN OPTICAL PRINT HEAD

TECHNICAL FIELD

The present invention relates to an optical print head, an image forming apparatus including an optical print head which reciprocates between an exposure position where a photosensitive drum is exposed to light and a retracted position retracted from the exposure position and the photosensitive drum in order to exchange an exchange unit including the photosensitive drum.

BACKGROUND ART

An image forming apparatus, such as a printer and a copying machine, includes an optical print head provided with a plurality of light emitting elements for exposing a photosensitive drum to light. There are optical print heads that use, for example, an LED (light emitting diode) or an organic EL (electro-luminescence) device as a light emitting element (device). A plurality of the light emitting elements may be arranged along a rotational axis direction of the photosensitive drum in a row (line) or in two rows (lines) with a staggered pattern. Further, the optical print head may include a plurality of lenses for concentrating light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum. The light beams emitted from the plurality of light emitting elements are concentrated on the surface of the photosensitive drum through the lenses. As a result, an electrostatic latent image is formed on the surface of the photosensitive drum.

The photosensitive drum is one of consumables, and therefore is exchanged periodically. An operator such as a user or maintenance person can perform maintenance of the image forming apparatus by exchanging the exchange unit including a photosensitive drum. The exchange unit is mountable in and dismountable from an image forming apparatus main assembly by being extracted from and inserted into the image forming apparatus main assembly. At an exposure position (position close to an opposing a drum surface) which is a position of the optical print head when the optical print head exposes the photosensitive drum to light, an interval between the lenses and the photosensitive drum surface is very narrow. Therefore, during exchange of the exchange unit, there is a possibility that the optical print head and the photosensitive drum or the like contact each other and the photosensitive drum surface and the lenses are damaged if the optical print head is retracted from the exposure position. Therefore, there is a need that the image forming apparatus is provided with a mechanism for reciprocating the optical print head between the exposure position and a retracted position where the optical print head is retracted from the exchange unit than the exposure position is.

In Japanese Laid-Open Patent Application (JP-A) 2013-134370, a mechanism for moving the optical print head between the exposure position and the retracted position is disclosed. An LED unit 12 shown in FIG. 2 of JP-A 2013-134370 includes an LED array 50, a first frame for supporting the LED array 50, and a moving mechanism 60 for moving the LED array 50 between the exposure position and the retracted position. The LED array 50 is supported by the first frame 51. Further, the first frame 51 is provided with two positioning rollers 53 opposing a photosensitive drum 15 on both (opposite) end sides with respect to a longitudinal direction thereof. On each of the both end sides of the first frame 51 with respect to the longitudinal direction, one end of a compression spring 54 is mounted on an opposite side from a side where the photosensitive drum 15 is disposed. The other ends of the respective compression springs 54 are mounted on both end sides, with respect to a longitudinal direction, respectively of a holding member 63 provided on an opposite side from the side where the photosensitive drum 15 is disposed. That is, the first frame 51 is supported by the holding member 63 through the compression springs 54. The first frame 51 is movable in a direction in which the first frame 51 reciprocates between the exposure position and the retracted position.

The moving mechanism 60 is disposed on an opposite side with respect to the LED array 50 from the side where the photosensitive drum 15 is disposed, and includes a holding member 63, a slidable member 61 sliding (moving) relative to a main assembly casing 2 with an opening and closing operation of a front cover 5 provided to the main assembly casing 2, and a movable member 62 moving the LED array 50 to the exposure position and the retracted position in interrelation with the slide (movement) of the slidable member 61.

By the above-described constitution, when the slidable member slides (moves) in interrelation with the opening and closing contact pin of the front cover 5, the holding member 63 reciprocates between the exposure position and the retracted position. Further, with the movement of the holding member 63, the first frame 51 and the LED array 50 also move in a direction in which the first frame 51 and the LED array 50 reciprocate between the exposure position and the retracted position. When the first frame moves from the retracted position to the exposure position, the positioning roller 53 contacts the photosensitive drum 13, and the compression spring 54 is compressed. By a restoring force of the compressed compression spring 54, the positioning roller 53 toward the photosensitive drum 15 is urged, so that a gap is formed between the photosensitive drum 15 and the LED array 50 and thus the LED array 50 is in the exposure position.

SUMMARY OF THE INVENTION

Problem to be Solved by the Invention

However, in a constitution, disclosed in the above-described JP-A 2013-134370, in which the slidable member 61 slides (moves) corresponding to rotation of the front cover 5 and the movable member 62 moves, the following problem arises.

A mechanism disclosed in the above-described JP-A 2013-134370 is a structure in which the front cover 5 is gradually closed, and after the LED array 50 moves to the exposure position, the front cover 5 is further closed, so that a compression spring 54 is compressed. However, in the constitution in which the slidable member 61 slides (moves) correspondingly to the rotation of the front cover 5, a difference among individual portions of the LED unit 12 due to a tolerance among component parts constituting the moving mechanism 60 changes spring pressure of the compression spring 54 for each of the portions when the front cover 5 is completely closed, so that an influence thereof is nonnegligible in some instances.

Means for Solving the Problem

A first aspect of the invention relates to an image forming apparatus. The image forming apparatus of the first aspect includes a drum unit, an optical print head, a rotatable member, and urging portion and a moving mechanism. The drum unit rotatably supports a photosensitive drum and is mountable in and dismountable from an apparatus main assembly by inserting and extracting the drum unit from a side surface of the apparatus main assembly on a front side. The optical print head is for exposing the photosensitive drum to light. The rotatable member which rotates about a rotational axis, as a rotation center. The rotational axis passes through a lower side of a rotational axis of the photosensitive drum with respect to a vertical direction and extends in a direction perpendicular to both of a longitudinal direction of the optical print head and the vertical direction. The rotatable member is movable between a closed position where a movement path of the drum unit when the drum unit is inserted in and extracted from the apparatus main assembly is closed and an open position where the movement path opens. The urging portion is provided on the rotatable member at a lower side of the rotational axis with respect to the vertical direction and moves together with the rotating rotatable member around the rotational axis. The moving mechanism is for moving the optical print head from a retracted position where the optical print head is retracted from the drum unit to permit insertion and extraction of the drum unit toward an exposure position where the drum unit is urged for exposing the photosensitive drum to light. The moving mechanism includes a slidable portion, a spring, and a link portion. The slidable portion includes a portion-to-be-urged positioned on a movement locus of the urging portion moving around the rotational axis of the rotatable member with rotation of the rotatable member from the open position to the closed position and urged by the moving urging member. The slidable portion also includes a curved portion provided adjacently to the portion-to-be-urged on a side downstream of the portion-to-be-urged with respect to the movement direction on the movement locus and forming a shape along the movement locus. The slidable portion slides in one direction with respect to the longitudinal direction relative to the apparatus main assembly. The spring is provided in the optical print head and imparts, to the optical print head, an urging force for urging the optical print head toward the drum unit. The link portion is rotatably connected to the optical print head on one end side and rotatably connected to the slidable portion on the other end side. The link portion rotates with the slide of the slidable portion and deforms the spring in interrelation with the rotation. The urging portion urges the portion-to-be urged with the rotation of the rotatable member, and the link member moves the optical print head from the retracted position to the exposure position. Thereafter, the urging portion is moved from the portion-to-be-urged onto the curved portion and is moved along the shape of the curved portion by further rotation of the rotatable member, whereby the slidable portion and the link portion are kept in a rest state without being moved with the rotation of the rotatable member.

A second aspect of the invention relates to an image forming apparatus of a second invention. The image forming apparatus of the second aspect of the invention includes a drum unit, an optical print head, a rotatable member, an urging portion, and a moving mechanism. The drum unit rotatably supports a photosensitive drum and is mountable in and dismountable from an apparatus main assembly by inserting and extracting the drum unit from a side surface of the apparatus main assembly on a front side. The optical print head is for exposing the photosensitive drum to light. The rotatable member rotates about a rotational axis, as a rotation center. The rotational axis passes through a lower side of a rotational axis of the photosensitive drum with respect to a vertical direction and extends in a direction perpendicular to both of a longitudinal direction of the optical print head and the vertical direction. The rotatable member is movable between a closed position where a movement path of the drum unit when the drum unit is inserted in and extracted from the apparatus main assembly is closed and an open position where the movement path opens. The urging portion is provided on the rotatable member at a lower side of the rotational axis with respect to the vertical direction and moves together with the rotating rotatable member around the rotational axis. The moving mechanism is for urging the optical print head toward the drum unit by moving the optical print head from a retracted position where the optical print head is retracted from the drum unit to permit insertion and extraction of the drum unit toward the drum unit for exposing the photosensitive drum to light. The moving mechanism includes a slidable portion, a spring, and a link portion. The slidable portion includes a portion-to-be-urged positioned on a movement locus of the urging portion moving around the rotational axis of the rotatable member with rotation of the rotatable member from the open position to the closed position and urged by the moving urging member. The slidable portion also includes a curved portion provided adjacently to the portion-to-be-urged on a side downstream of the portion-to-be-urged with respect to the movement direction on the movement locus and forming a shape along the movement locus. The slidable portion slides in one direction with respect to the longitudinal direction relative to the apparatus main assembly. The spring is provided in the optical print head and imparts, to the optical print head, an urging force for urging the optical print head toward the drum unit. The link portion is rotatably connected to the optical print head on one end side and rotatably connected to the slidable portion on the other end side. The link portion rotates with the slide of the slidable portion and deforms the spring in interrelation with the rotation. In order that a rotation amount of the first portion relative to a rotation amount of the rotatable member when the urging portion urges the curved portion is less than a rotation amount of the link portion relative to a rotation amount of the rotatable member when the urging portion urges the portion-to-be-urged, an amount of the slide of the slidable portion per unit rotation amount of the rotatable member when the urging portion urges the curved portion is less than an amount of the slide of the slidable portion per unit rotation amount of the rotatable member when the urging portion urges the portion-to-be-urged.

Effect of the Invention

According to the first aspect of the invention, during contact of the urging portion with the curved portion, even when a movable member is rotated, the slidable portion is in the rest state, and therefore, a movable portion does not move.

According to the second aspect of the invention, compared with the case where the urging portion contacts a first portion-to-be-urged, in the case where the urging portion contacts the curved portion, a movement amount of the slidable portion per unit rotation amount of the rotatable member and the rotation amount of the link portion can be reduced.

EMBODIMENTS FOR CARRYING OUT THE INVENTION

Embodiment (Image Forming Apparatus)

Figure 1:
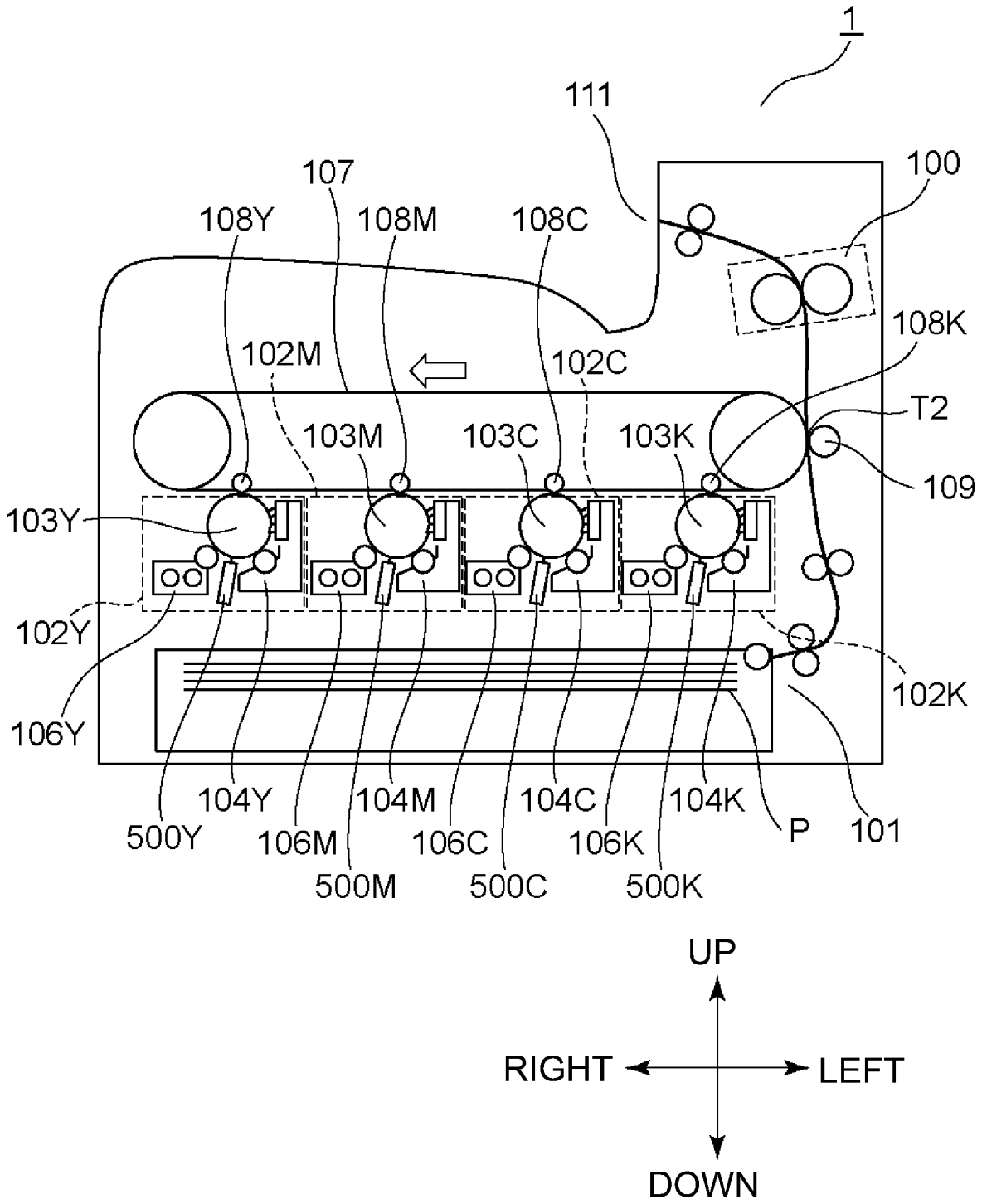
FIG. 1 is a schematic sectional view of an image forming apparatus.

First, a schematic structure of an image forming apparatus 1 will be described. FIG. 1 is a schematic sectional view of the image forming apparatus 1. The image forming apparatus 1 shown in FIG. 1 is a color printer (SFP: small function printer) including no reading device but may also be a copying machine including a reading device. Further, the embodiment is not limited to a color image forming apparatus including a plurality of photosensitive drums 103. The embodiment may also be a color image forming apparatus including a single photosensitive drum 103 or an image forming apparatus for forming a monochromatic image.

The image forming apparatus 1 shown in FIG. 1 includes four image forming portions 102Y, 102M, 102C and 102K (hereinafter collectively referred simply to as also an "image forming portion 102") for forming toner images of yellow, magenta, cyan and black. The image forming portions 102Y, 102M, 102C and 102K include photosensitive drum 103Y, 103M, 103C and 103K (hereinafter collectively referred simply to as also a "photosensitive drum 103"). Further, the image forming portions 102Y, 102M, 102C and 102K include charging devices 104Y, 104M, 104C and 104K (hereinafter collectively referred simply to as also a "charging device 104") for electrically charging the photosensitive drums 103Y, 103M, 103C and 103K. The image forming portions 102Y, 102M, 102C and 102K further include LED (light emitting diode, hereinafter described as LED) exposure units 500Y, 500M, 500C and 500K (hereinafter collectively referred simply to as also a "exposure unit 500") as light sources for emitting light (beams) to which the photosensitive drums 103Y, 103M, 103C and 103K are exposed. Further, the image forming portions 102Y, 102M, 102C and 102K include developing devices 106Y, 106M, 106C and 106K (hereinafter collectively referred simply to as also a "developing device 106") each for developing an electrostatic latent image on the photosensitive drum 103 with toner into a toner image of an associated color on the photosensitive drum 103. Y, M, C and K added to symbols represent colors of the toners.

The image forming apparatus 1 includes an intermediary transfer belt 7 onto which the toner images formed on the photosensitive drums 103 are to be transferred and primary transfer rollers 108 (Y, M, C, K) for successively transferring the toner images, formed on the photosensitive drums 103 of the respective image forming portions 102, onto the intermediary transfer belt 107. The image forming apparatus 1 further includes a secondary transfer roller 109 for transferring the toner images from the intermediary transfer belt 107 onto recording paper P fed from a sheet (paper) feeding portion 101 and includes a fixing device 100 for fixing the secondary-transferred toner images on the recording paper P.

(Drum Unit)

Figure 2:
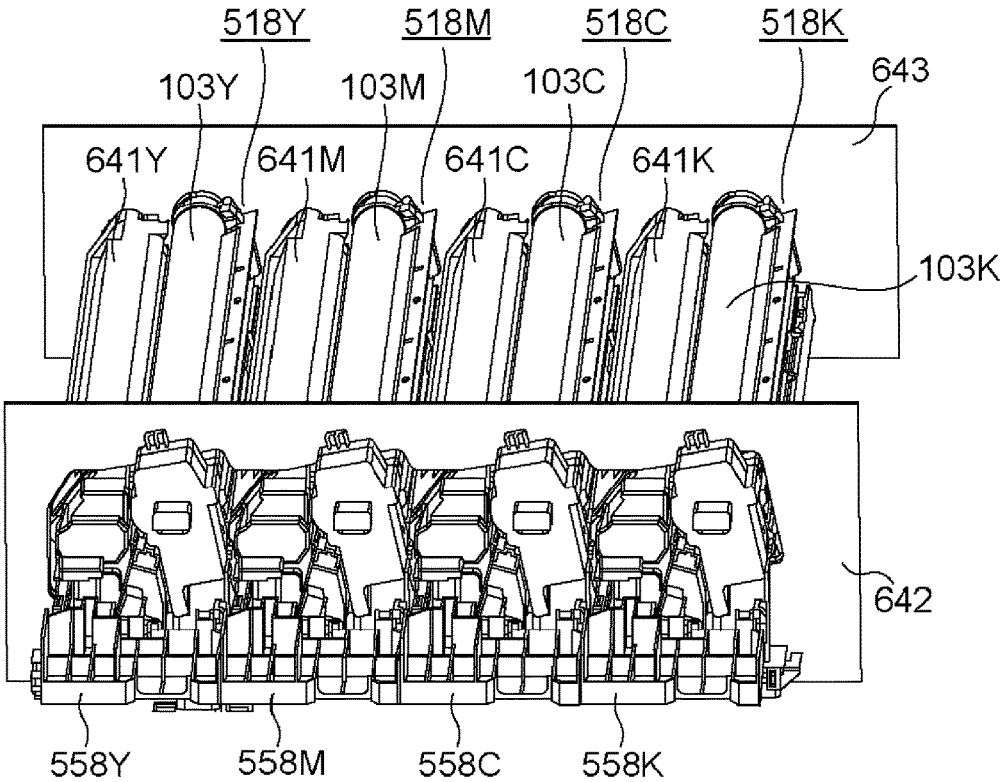
FIG. 2 includes perspective views showing a drum unit and a periphery thereof in the image forming apparatus.
Figure 2:
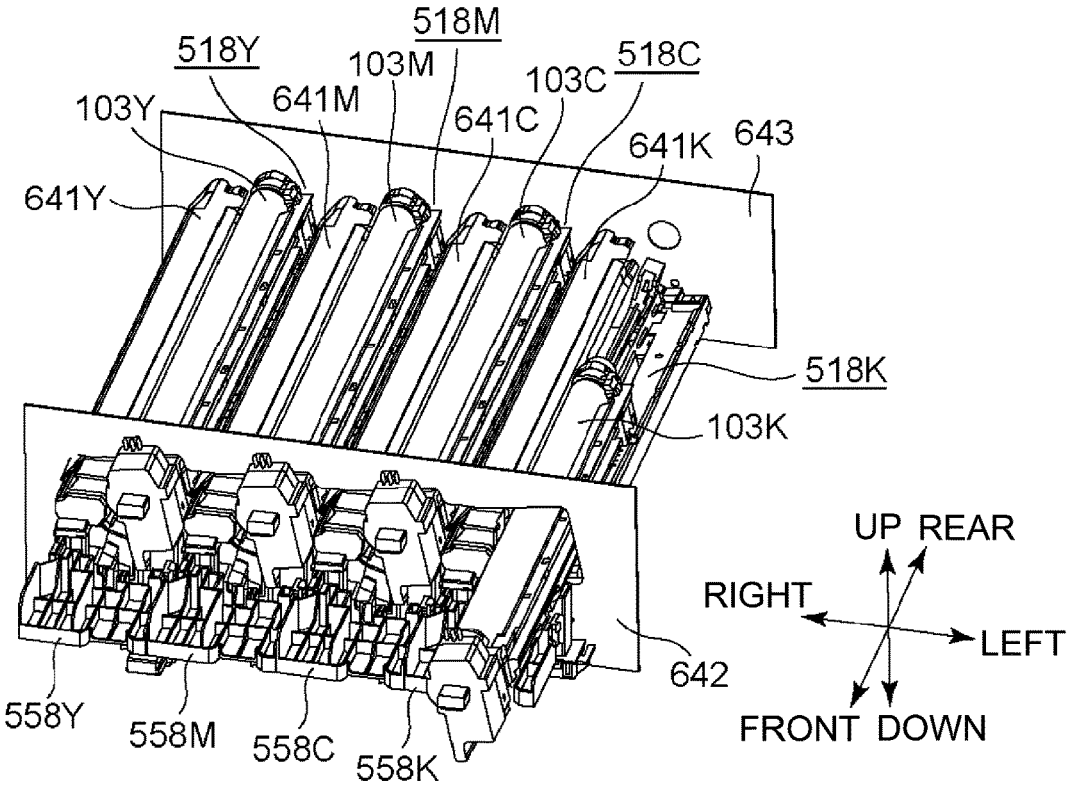

Then, drum units 518 (Y, M, C, K) and developing units 641 (Y, M, C, K) which are an example of an exchange unit mountable in and dismountable from the image forming apparatus 1 according to this embodiment will be described. Part (a) of FIG. 2 is a schematic perspective view of a periphery of the drum units 518 and the developing units 641. Part (b) of FIG. 2 is a view showing a state in which the drum unit 518 is being inserted from an outside of the apparatus main assembly into the image forming apparatus 1.

As shown in part (a) of FIG. 2, the image forming apparatus 1 includes a front side plate 642 and a rear side plate 643 which are formed with a metal plate. The front side plate 642 is a side wall provided on a front surface side (front side) of the image forming apparatus 1. On the other hand, the rear side plate 643 is a side wall provided on a rear surface side (rear side) of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame of the image forming apparatus 1.

The front side plate 642 is provided with an opening through which the drum unit 518 and the developing unit 641 can be inserted and extracted. The drum unit 518 and the developing unit 641 are mounted at a predetermined position (mounting position) of the main assembly of the image forming apparatus 1 through the opening. Further, the image forming apparatus 1 includes covers 558 (Y, M, C, K) as an example of rotatable members for covering a front side of the drum unit 518 and the developing unit 641 which are mounted in the mounting position. The cover 558 is fixed at one end thereof to the main assembly of the image forming apparatus 1 by a hinge, whereby the cover 558 is rotatable relative to the main assembly of the image forming apparatus 1. The operator, when performing maintenance, opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation of the unit is completed. The cover 558 will be further specifically described later.

As shown in parts (a) and (b) of FIG. 2, in the following description, the front side plate 642 side and the rear side plate 643 side are defined as a front side (front side) and a rear side (rear side), respectively. Further, when a position of the photosensitive drum 103K on which the electrostatic latent image relating to the black toner image is formed is taken as a reference (position), a side where the photosensitive drum 103Y on which the electrostatic latent image relating to the yellow toner image is formed is disposed is defined as a right side. Further, when a position of the photosensitive drum 103Y is taken as a reference (position), a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, with respect to a rotational axis direction of the photosensitive drum 103, one end side means the front side (front side) and the other end side means the rear side (rear side). Further, one end side and the other end side with respect to the front-rear direction also correspond to the front side and the rear side, respectively. Further, with respect to the left-right direction, one end side means the right side and the other end side means the left side.

In the image forming apparatus 1 of this embodiment, the drum unit 518 is mounted. The drum unit 518 is a cartridge to be exchanged. The drum unit 518 of this embodiment includes the photosensitive drum 103 rotatably supported by the casing of the drum unit 518. The drum unit 518 includes the photosensitive drum 103, the charging device 104 and an unshown cleaning device. When the photosensitive drum 103 reaches an end of a lifetime thereof, for example, due to abrasion through cleaning by the cleaning device, the operator, when performing maintenance takes the drum unit 518 out of the apparatus main assembly and exchanges the photosensitive drum 103 as shown in part (b) of FIG. 2. The drum unit 518 may also have a constitution in which the charging device 104 and the cleaning device are not provided and the photosensitive drum 103 is provided.

In the image forming apparatus 1 of this embodiment, the developing unit 641, which is a separate member from the drum unit 518, is mounted. The developing unit 641 includes the developing device 106 shown in FIG. 1. The developing device 106 includes a developing sleeve which is a developer carrying member for carrying the developer. The developing unit 641 is provided with a plurality of gears for rotating a screw for stirring toner and a carrier. When these gears are deteriorated because of ageing, the operator, when performing maintenance takes the developing unit 641 out of the apparatus main assembly of the image forming apparatus 1. The developing unit 641 of this embodiment is a cartridge which is an integrally assembled unit of the developing device 106 including the developing sleeve and a toner accommodating portion provided with the screw. Incidentally, an embodiment of the drum unit 518 and the developing unit 641 may also be a process cartridge which is an integrally assembled unit of the above-described drum unit 518 and developing unit 641.

(Image Forming Process)

Next, an image forming process will be described. An optical print head 105Y described later exposes the surface of the photosensitive drum 103, charged by the charging device 104Y, to light. By this, an electrostatic latent image is formed on the photosensitive drum 103Y. Then, the developing device 106Y develops the electrostatic latent image, formed on the photosensitive drum 103Y, with yellow toner. A yellow toner image into which the electrostatic latent image is developed on the photosensitive drum 103Y is transferred onto the intermediary transfer belt 107 by the primary transfer roller 108Y at the primary transfer portion Ty. Magenta, cyan and black toner images are also transferred onto the intermediary transfer belt 107 by a similar image forming process.

The respective color toner images transferred on the intermediary transfer belt 107 are conveyed to a secondary transfer portion T2 by the intermediary transfer belt 107. A transfer bias, for transferring the toner images onto the recording paper P, is applied to a secondary transfer roller 109 provided at the secondary transfer portion T2. The toner images conveyed to the secondary transfer portion T2 are transferred onto the recording paper P, fed from the sheet (paper) feeding portion 101, by the transfer bias applied to the secondary transfer roller 109. The recording paper P on which the toner images are transferred is conveyed to the fixing device 100. The fixing device 100 fixes the toner images on the recording paper P by heat and pressure. The recording paper P subjected to a fixing process by the fixing device 100 is discharged onto a sheet (paper) discharge portion 111.

(Exposure Unit)

Figure 3:
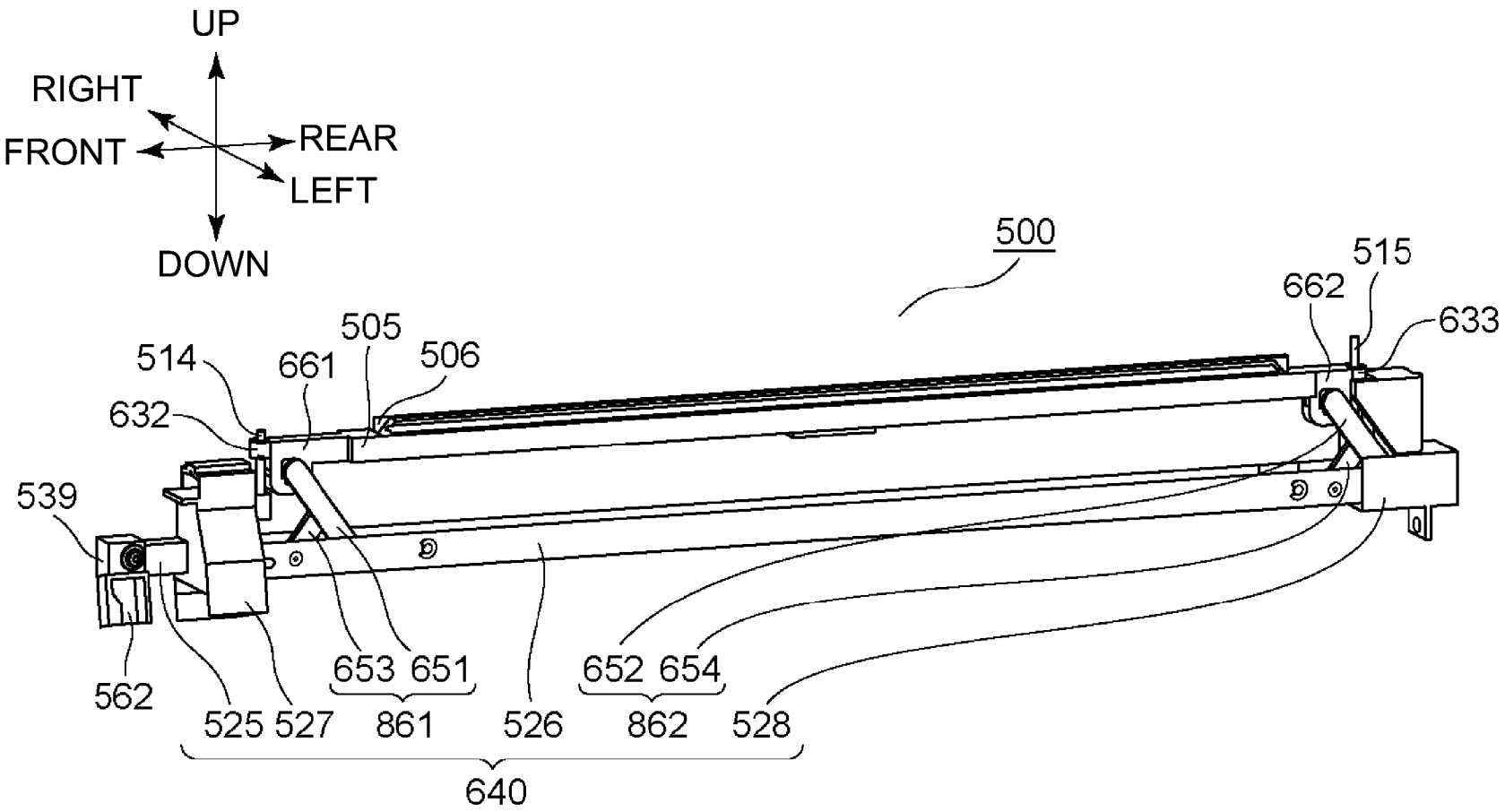
FIG. 3 is a schematic perspective view of an exposure unit.
Figure 4:
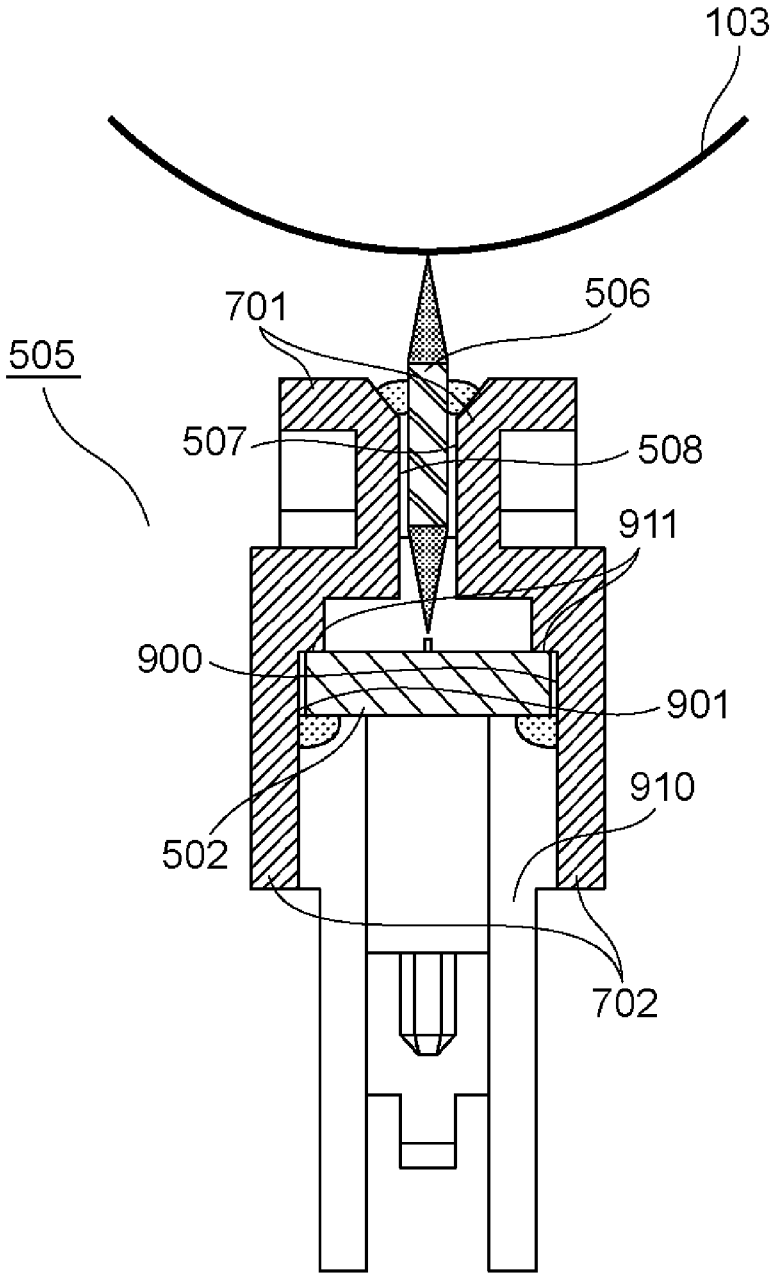
FIG. 4 is a sectional view of an optical print head with respect to a direction perpendicular to a rotational axis direction of a photosensitive drum.

Next, the exposure unit 500 including an optical print head 105 will be described. Here, as an example of an exposure type employed in an image forming apparatus of an electrophotographic type, there is a laser beam scanning exposure type in which the photosensitive drum is scanned with a beam emitted from a semiconductor laser by a rotating polygon mirror or the like and the photosensitive drum is exposed to the beam through of f-θ lens or the like. The "optical print head 105" described in this embodiment is used in an LED exposure type in which the photosensitive drum 103 is exposed to light by using light emitting elements such as LEDs or the like arranged along the rotational axis direction of the photosensitive drum 103 and thus is not used in the laser beam scanning exposure type described above. FIG. 3 is a schematic perspective view of the exposure unit 500 provided in the image forming apparatus 1 of this embodiment. FIG. 4 includes schematic sectional views in which the exposure unit 500 shown in FIG. 3 and the photosensitive drum 103 disposed on an upper side of the exposure unit 500 are cut along a surface perpendicular to the rotational axis direction of the photosensitive drum 103. The exposure unit 500 includes the optical print head 105 and a moving mechanism 640.

The optical print head 105 includes a holding member 505 for holding a lens array 506 (lenses) and a substrate 502, a contact pin 514, and a contact pin 515. Although details will be described later, the contact pin 514 projects toward the drum unit 518 side on one end side (front side) of the holding member 505 with respect to the rotational axis direction of the photosensitive drum 103. Further, the contact pin 515 projects toward the drum unit 518 side on the other end side (rear side) of the holding member 505 with respect to the rotational axis direction of the photosensitive drum 103. The moving mechanism 640 includes a first link mechanism 861, a second link mechanism 862, a slidable portion 525, a first supporting portion 527, a second supporting portion 528, and a third supporting portion 526 as an example of a slide supporting portion. The link mechanism 861 includes a link member 651 and a link member 653, and the link mechanism 862 includes a link member 652 and a link member 654. Here, in this embodiment, the contact pin 514 and the contact pin 515 are cylindrical pins, but a shape thereof is not limited to a cylinder and may also be shapes such as a prism and a cone having a diameter narrower toward an end portion thereof.

First, the holding member 505 will be described. The holding member 505 is a holder holding the substrate 502 described later, the lens array 506, the contact pin 514 and the contact pin 515. In this embodiment, as an example, a length of the contact pin 514 projecting from an upper surface of the holding member 505 is 7 mm, a length of the contact pin 515 projecting from the upper surface of the holding member 505 is 11 mm, a length of the contact pin 514 projecting from a lower surface of the holding member 505 is 22 mm, and a length of the contact pin 515 projecting from the lower surface of the holding member 505 is 22 mm. As shown in FIG. 4, the holding member 505 includes a lens mounting portion 701 where the lens array 506 is mounted and a substrate mounting portion 702 where the substrate 502 is mounted. Further, although described later specifically the holding member 505 includes a spring mounting portion 661 (662) and a pin mounting portion 632 (633). The holding member 505 is a mode, mad of a resin, prepared by integrally subjecting the lens mounting portion 701, the substrate mounting portion 702, the spring mounting portion 661 and the spring mounting portion 662 to injection molding. Incidentally, a material of the holding member 505 is not limited to the resin, but may also be made of metal, for example.

As shown in FIG. 3, the spring mounting portion 661 where the link member 651 is mounted is provided between the lens array 506 and the pin mounting portion 632 with respect to a front-rear direction. Further, the spring mounting portion 662 where the link member 152 is mounted is provided between the lens array 506 and the pin mounting portion 633 with respect to the front-rear direction. That is, when the optical print head 105 moves between the exposure position and the retracted position, the holding member 505 is supported by the link member 651 between the lens array 506 and the contact pin 514 in the front-rear direction, and is supported by the link member 152 between the lens array 506 and the contact pin 515 in the front-rear direction. Portions where an urging force is imparted to the holding member 505 by the link member 651 and the link member 152 do not overlap with the lens array 506 with respect to an up-down direction, and therefore, flexure of the lens array 506 by the urging force is reduced.

The lens mounting portion 701 includes a first inner wall surface 507 extending in a longitudinal direction of the holding member 505, and a second inner wall surface 508 which opposes the first inner wall surface 507 and which similarly extends in the longitudinal direction of the holding member 505. During assembling of the optical print head 105, the lens array 506 is inserted between the first inner wall surface 507 and the second inner wall surface 508. Then, an adhesive is applied between side surface of the lens array 506 and the lens mounting portion 701, whereby the lens array 506 is fixed to the holding member 505.

As shown in FIG. 4, the substrate mounting portion 702 has a substantially U-character-like shape in cross-section and includes a third inner wall surface 900 extending in the longitudinal direction of the holding member 505 and a fourth inner wall surface 901 which opposes the third inner wall surface 900 and which extends in the longitudinal direction of the holding member 505. A gap 910 for permitting insertion of the substrate 502 is formed between the third inner wall surface 900 and the fourth inner wall surface 901. Further, the substrate mounting portion 702 includes a substrate contact portion 911 to which the substrate 502 is contacted. During the assembling of the optical print head 105, the substrate 502 is inserted from the gap 910 and is pushed to the substrate contact portion 911. Then, in a state in which the substrate 502 contacts the substrate contact portion 911, the adhesive is applied onto boundary portions between the substrate 502 and the third inner wall surface 900 and between the substrate 502 and the fourth inner wall surface 901 on the gap 910 side, whereby the substrate 502 is fixed to the holding member 505. The exposure unit 500 is provided on a side below a rotational axis of the photosensitive drum 103 with respect to a vertical direction, and LEDs 503 of the optical print head 105 expose the photosensitive drum 103 to light from below.

Figure 5:
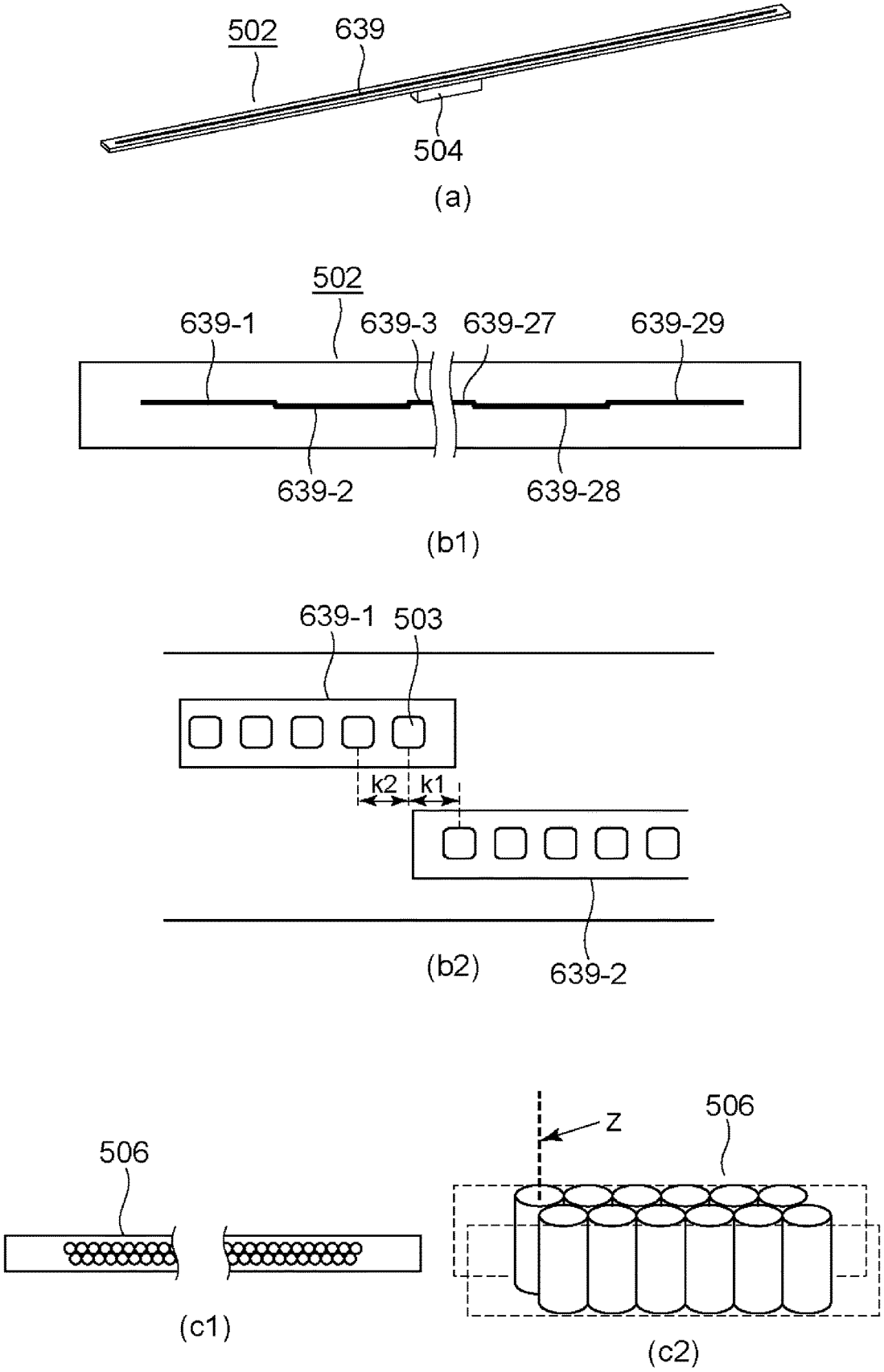
FIG. 5 includes schematic views for illustrating a substrate, an LED chip or a lens array of an optical print head.

Next, the substrate 502 held by the holding member 505 will be described. Part (a) of FIG. 5 is a schematic perspective view of the substrate 502. Part (b1) of FIG. 5 is a schematic view showing an arrangement of a plurality of LEDs 503 provided on the substrate 502, and Part (b2) of FIG. 5 is an enlarged view of part (b1) of FIG. 5.

On the substrate 502, LED chips 639 are mounted. As shown in part (a) of FIG. 5, on one surface of the substrate 502, the LED chips 639 are provided, and on the back surface side of the substrate 502, a connector 504 is provided. On the substrate 502, electrical wiring for supplying signals to the respective LED chips 639. To the connector 504, one end of an unshown flexible flat cable (FFC) is connected. In the image forming apparatus 1 main assembly, a substrate is provided. The substrate includes a controller and a connector. The other end of the FFC is connected to the connector. To the substrate 502, a control signal is inputted from the controller of the image forming apparatus 1 main assembly through the FFC and the connector 504. The LED chips 639 are driven by the control signal inputted to the substrate 502.

The LED chips 639 mounted on the substrate 502 will be described further specifically. As shown in parts (b1) and (b2) of FIG. 5, on one surface of the substrate 502, a plurality of LED chips 639-1 to 639-29 (29 LED chips) where a plurality of LEDs 503 are disposed. On each of the LED chips 639-1 to 639-29, 516 LEDs (light emitting elements) are arranged in a line along a longitudinal direction of the LED chips 639. With respect to the longitudinal direction of the LED chips 639, a center distance k2 between adjacent LEDs corresponds to resolution of the image forming apparatus 1. The resolution of the image forming apparatus 1 is 1200 dpi, and therefore, in the longitudinal direction of the LED chips 639-1 to 639-29, the LEDs arranged in a line so that the center distance of the LEDs is 21.16 μm. For that reason, an exposure range of the optical print head 105 in this embodiment is about 316 mm. A photosensitive layer on the photosensitive drum 103 is formed with a width of 316 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two lines along the rotational axis direction of the photosensitive drum 103. That is, as shown in part (b1) of FIG. 5, odd-numbered LED chips 639-1, 639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 5, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs on one (e.g., 639-1) of LED chips 639.

Incidentally, in this embodiment, a constitution using the LEDs as an exposure light source is described as an example, but as the exposure light source, an organic EL (electro luminescence) device may also be used.

Next, a lens array 506 will be described. Part (c1) of FIG. 5 is a schematic view of the lens array 506 as seen from the photosensitive drum 103 side. Further, part (c2) of FIG. 5 is a schematic perspective view of the lens array 506. As shown in part (c1) of FIG. 5, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent lenses arranged in the arrangement direction of the lenses arranged in the above-described one line. Each of the lenses is a cylindrical rod lens made of glass. Incidentally, a material of the lens is not limited to glass but may also be plastics. Also a shape of the lens is not limited to the cylindrical shape but may also be a polygonal prism shape such as a hexagonal prism shape.

A broken line Z shown in part (c2) of FIG. 5 represents an optical axis of the lens. The optical print head 105 is moved by the above-described moving mechanism 640 in a direction along the optical axis of the lens indicated by the broken line Z. The optical axis of the lens referred to herein means a line connecting a center of a light emitting (emergent) surface of the lens and a focus of the lens. As shown in FIG. 4, emitted light emitted from the LED enters the lens included in the lens array 506. The light entering the lens is concentrated on the surface of the photosensitive drum 103. A mounting position of the lens array 506 relative to the lens mounting portion 701 during assembling of the optical print head 105 is adjusted so that a distance between a light emitting surface of the LED and a light incident surface of the lens and a distance between a light emitting surface of the lens and the surface of the photosensitive drum 103 are substantially equal to each other.

Figure 6:
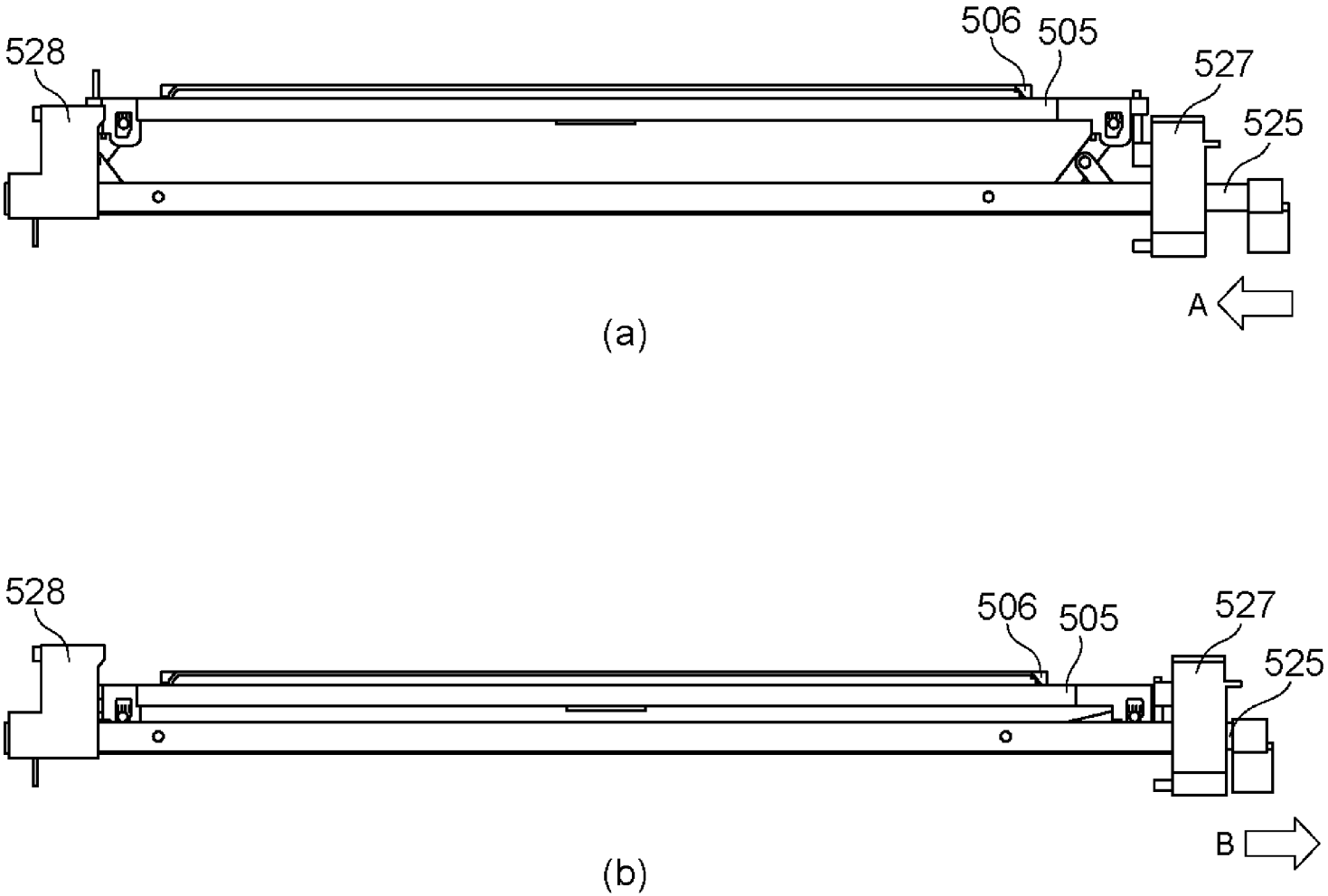
FIG. 6 includes side views of the optical print head.

Here, necessity of movement of the optical print head 105 will be described. The image forming apparatus 1 of this embodiment slides (moves) the drum unit 518 in the rotational axis direction of the photosensitive drum 103 toward the front side of the apparatus main assembly when the drum unit 518 is exchanged, as described with reference to FIG. 2. When the drum unit 518 is moved in a state in which the optical print head 105 is positioned in the neighborhood of the surface of the photosensitive drum 103, the optical print head 105 contacts the sliding (moving) photosensitive drum 103, so that the surface of the photosensitive drum 103 to be mounted is damaged. Further, the lens array 506 contacts the frame of the drum unit 518, so that the lens array 506 is damaged. For that reason, a structure in which the optical print head 105 is reciprocated between an exposure position (part (a) of FIG. 6) where the photosensitive drum 103 is exposed to light and a retracted position (part (b) of FIG. 6) retracted from the exposure position. When the slidable portion 525 slides (moves) in an arrow A direction in a state in which the optical print head 105 is in the exposure position (part 8*a*) of FIG. 6), the optical print head 105 moves in a direction toward the retracted position (part (b) of FIG. 6). On the other hand, when the slidable portion 525 slides (moves) in an arrow B direction in a state in which the optical print head 105 is in the retracted position (part (b) of FIG. 6), the optical print head 105 moves in a direction toward the exposure position (part (a) of FIG. 6). Details will be described later.

Figure 7:
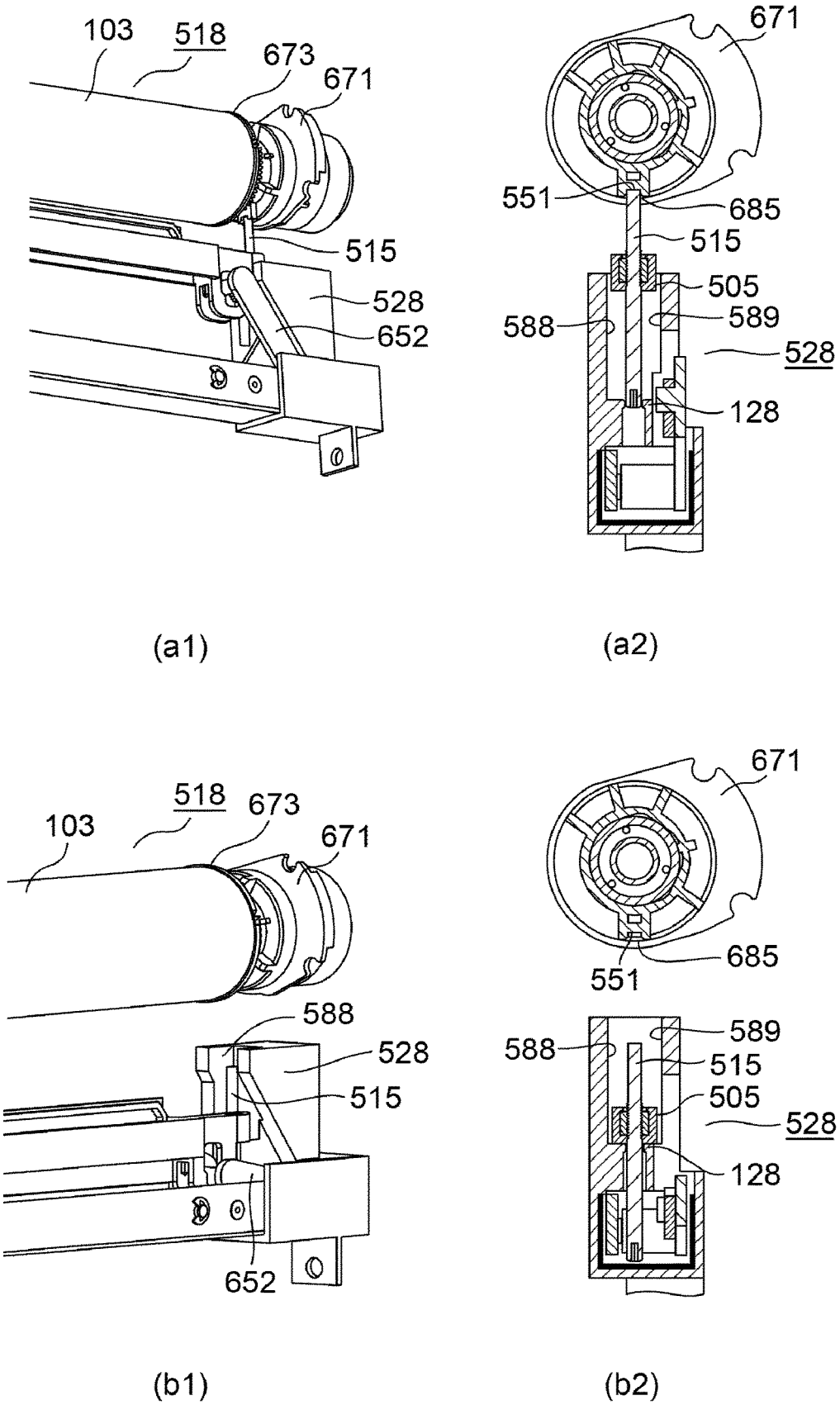
FIG. 7 includes views each showing a state in which the optical print head is contacted to or retracted from a drum unit.

Part (a1) of FIG. 7 is a perspective view showing the rear side of the optical print head 105 positioned at the exposure position and a bush 671 provided on the rear side of the drum unit 518. Part (a2) of FIG. 7 is a sectional view showing the second supporting portion 528 and the bush 671 provided on the rear side of the drum unit 518 when the optical print head 105 is positioned at the end portion position. Part (b1) of FIG. 7 is a perspective view showing the rear side of the optical print head 105 positioned at the retracted position and a bush 671 provided on the rear side of the drum unit 518. Part (b2) of FIG. 7 is a sectional view showing the second supporting portion 528 and the bush 671 provided on the rear side of the drum unit 518 when the optical print head 105 is positioned at the retracted position.

Using FIG. 7, a state in which the contact pin 515 provided on the rear side of the optical print head 105 contacts the bush 671 provided on the drum unit 518 side will be described. Also on the front side of the drum unit 518, a component part corresponding to the bush 671 to which the contact pin is contacted is provided, and a structure thereof is similar to a structure of the bush 671, and a function thereof is also substantially identical to a function of the bush 671. Here, only a state in which the contact pin 515 openings the bush 671 provided on the drum unit 518 side will be described.

From part (a1) of FIG. 7 and part (b1) of FIG. 7, a portion where the link member 652 is mounted on the holding member 505 is on the photosensitive drum 103 side than an end portion, of both ends (end portions) of the contact pin 515 with respect to the up-down direction (direction in which the optical print head 105 moves between the exposure position and the retracted position: reciprocal movement direction), on a side opposite from the exchange unit side (side where the exchange unit 518 is disposed) is. The spring mounting portion 662 where the link member 652 is mounted is disposed so as not to cross the contact pin 515 with respect to the up-down direction. Further, although not shown in the figure here, also a portion where the link member 651 is mounted on the holding member 505 is on the photosensitive drum 103 side than an end portion, of both ends (end portions) of the contact pin 514 with respect to the up-down direction (direction in which the optical print head 105 moves between the exposure position and the retracted position: reciprocal movement direction), on a side opposite from the exchange unit side (side where the exchange unit 518 is disposed) is. The spring mounting portion 661 where the link member 651 is mounted is disposed so as not to cross the contact pin 514 with respect to the up-down direction. By this, upsizing of the exposure unit 500 with respect to the up-down direction is suppressed.

As shown in part (a2) of FIG. 7 and part (b2) of FIG. 7, the second supporting portion 528 includes a second bearing surface 587, a regulating portion 128, a first wall surface 588 and a second wall surface 589. The second bearing surface 587 is provided on the lower side of the holding member 505. The lower side of the holding member 505 moving from the exposure position toward the retracted position contacts the second bearing surface 587 and a first bearing surface 586 of a first supporting portion 527 described later from the upper side with respect to the vertical direction, so that the optical print head 105 is in the retracted position. The regulating portion 128 is a U-shaped recessed portion which is formed in the second supporting portion 528 and which opens toward the front side and is disposed on a side opposite from a side where the drum unit 518 is positioned relative to the holding member 505, and is engaged in the second supporting portion 528 from the rear side of the contact pin 515 so that the contact pin 515 is movable in the up-down direction. The contact pin 515 projecting from the lower side of the holding member 505 moves up and down together with the holding member 505 while moving in a gap formed by the regulating portion 128. Although not shown in the figure here, the first supporting portion 527 also includes a regulating portion 127. The regulating portion 127 is a U-shaped recessed portion which is formed in the first supporting portion 527 and which opens toward the front side and is disposed on a side opposite from a side where the drum unit 518 is positioned relative to the holding member 505, and is engaged in the second supporting portion 528 from the front side of the contact pin 514 so that the contact pin 514 is movable in the up-down direction. The contact pin 514 projecting from the lower side of the holding member 505 moves up and down together with the holding member 505 while moving in a gap formed by the regulating portion 127. The regulating portion 127 has a tapered shape in order to reduce a frictional force, to the extent possible, generated by contact with the contact pin 514. By this, the contact pin 514 can smoothly move up and down in a gap of the regulating portion 127. Accordingly, the holding member 505 integral with the contact pin 515 and the contact pin 514 is regulated (restricted) in movement in the direction crossing both the front-rear direction (rotational axis direction of the photosensitive drum 103) and the up-down direction (direction in which the optical print head 105 moves between the exposure position and the retracted position: reciprocal movement direction). Further, the regulating portion 127 may also regulated movement of the contact pin 514 from the rear side toward the front side, and the regulating portion 128 may also regulate (restrict) movement of the contact pin 515 from the rear side toward the front side.

The first wall surface 588 and the second wall surface 589 are disposed at opposing positions with respect to the left-right direction and form a gap. When the optical print head 105 reciprocates between the exposure position and the retracted position, the holding member 505 moves in the up-down direction in the gap formed by the first wall surface 588 and the second wall surface 589. During the movement, the holding member 505 is regulated (restricted) in movement in direction crossing both the front-rear direction (rotational axis direction of the photosensitive drum 103) and the up-down direction (direction in which the optical print head 105 moves position the exposure position and the retracted position: reciprocal movement direction) by the first wall surface 588 and the second wall surface 589.

By the above-described constitution, the optical print head 105 moves between the exposure position and the retracted position in a state in which the movement thereof in the direction crossing both the front-rear direction (rotational axis direction of the photosensitive drum 103) and the up-down direction (direction in which the optical print head 105 moves between the exposure position and the retracted position: reciprocal movement direction). Incidentally, at least one of the regulating portion 127 and the regulating portion 128 may be provided in the first supporting portion 527 or the second supporting portion 528. That is, it is sufficient if the regulating portion 127 is provided in the first supporting portion 527 as an example of the supporting portion or the regulating portion 128 is provided in the second supporting portion 528.

As shown in part (a1) of FIG. 7 and part (a2) of FIG. 7, positions where the opposing portion 515 contacts the bush 671 provided on the rear side of the drum unit 518 and where the contact pin 514 (not shown) contacts the component parts, corresponding to the bush 671, provided on the front side of the drum unit 518 are the exposure position of the optical print head 105. By contact of the contact pin 514 and the contact pin 515 with the bush 671 and the component part corresponding to the bush 671, respectively, a distance between the lens array 506 and the photosensitive drum 103 is a design nominal.

On the other hand, as shown in part (b1) of FIG. 7 and part (b2) of FIG. 7, a position where the contact pin 515 is retracted from the bush 671 provided on the rear side of the drum unit 518 corresponds to the retracted position of the optical print head 105. By positioning of the optical print head 105 in the retracted position shown in part (b1) of FIG. 7 and part (b2) of FIG. 7, the drum unit 518 sliding (moving) for exchange and the optical print head 105 and in a non-contact state.

Figure 8:
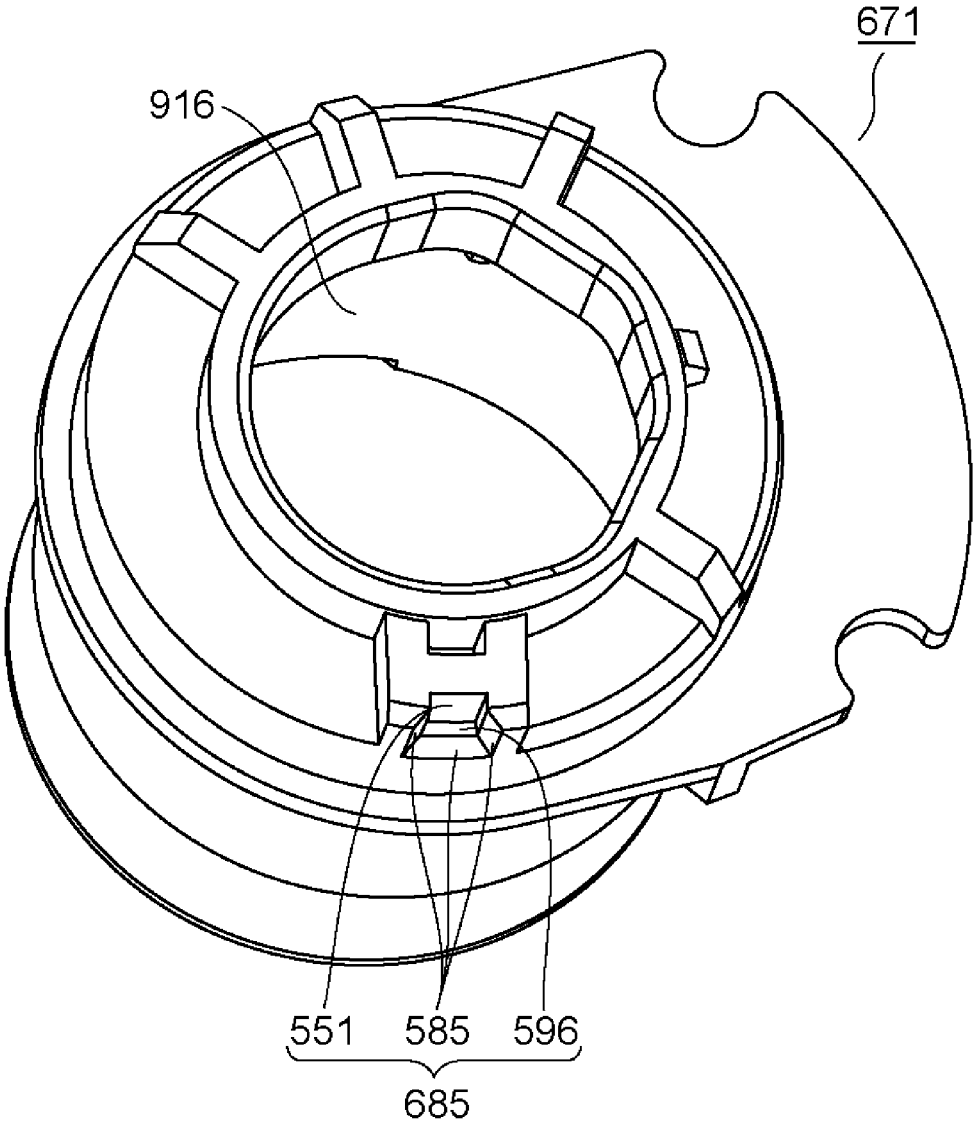
FIG. 8 is a perspective view of a bush mounted to the drum unit on a rear side.

Here, the bush 671 provided to the drum unit 518 will be described. In FIG. 8, a perspective view of the bush 671 is shown. The bush 671 is a member fixed to a casing of the drum unit 518 with a screw or an adhesive. As shown in FIG. 8, the bush 671 is provided with an opening 916. Into the opening 916, a shaft member of the photosensitive drum 103 on the other end side is rotatably inserted. That is, the bush 671 rotatably shaft-supports the photosensitive drum 103.

In the photosensitive drum 103, a photosensitive layer is formed on an outer wall surface of a hollow cylindrical aluminum tube. At both ends of the aluminum tube, flanges 673 are press-fitted. In the opening 916 formed in the bush 671, the flange 673 on the other end side of the photosensitive drum 103 is rotatably inserted. The flange 673 rotates while sliding with an inner wall surface of the opening 916. That is, the bush 671 rotatably shaft-supports the photosensitive drum 103. Further, also at a central portion of the component part, corresponding to the bush 671 to which the contact pin 514 is contacted and which is provided on the front side of the drum unit 518, an opening is formed similarly as in the bush 671. In the opening formed in the component part corresponding to the bush 671, the flange 673 on one end side (front side) of the photosensitive drum 103 is rotatably inserted. The flange 673 rotates while sliding with an inner wall surface of the opening. That is, similarly as the rear side of the drum unit 518, also on the front side, the bush 671 rotatably shaft-surfaces the photosensitive drum 103.

The bush 671 includes an engaging portion 685 in which the contact pin 515 is engaged. The engaging portion 685 includes a contact surface 551, a rear side wall surface 596 and a tapered portion 585. The engaging portion 685 may be recessed relative to the bush 671 or may stand relative to the bush 671. To the contact surface 551, the contact pin 515 moving in the direction from the retracted position toward the end portion position is contacted. At a lower end edge of the engaging portion 685, the tapered portion 585 having a tapered shape is formed. The tapered portion 585 guides movement of the contact pin 515 moving in the direction from the retracted position toward the exposure position so that the contact pin 515 contacts the contact surface 551. Contact between the rear side wall surface 596 and the contact pin 515 will be described later.

The contact pin 515 contacted to the contact surface 551 of the engaging portion 685 is restricted by the engaging portion 685 in movement in the direction crossing both the front-rear direction (rotational axis direction of the photosensitive drum 103) and the up-down direction (direction in which the optical print head 105 moves between the exposure position and the retracted position: reciprocal movement direction). That is, in the optical print head 105 positioned at the exposure position (see part (a2) of FIG. 7), an upper end of the contact pin 515 is restricted in movement in the direction crossing both the front-rear direction and the up-down direction by the engaging portion 685, and a lower end of the contact pin 515 is restricted in movement in the direction crossing both the front-rear direction and the up-down direction by the regulating (restricting) portion 128. Here, a difference between a diameter of the engaging portion 685 with respect to the left-right direction and a diameter of the upper end of the contact pin 515 with respect to the left-right direction and a difference between a diameter of the regulating portion 128 with respect to the left-right direction and the lower end of the contact pin 515 with respect to the left-right direction are smaller than difference between the gap between the first side wall surface 588 and the second side wall surface 589 with respect to the left-right direction and the holding member 505 positioned between the first side wall surface 588 and the second side wall surface 589. Accordingly, when the optical print head 105 is in the exposure position, the first wall surface 588 and the second wall surface 589 do not relates to restriction of movement of the optical print head 105 in the direction crossing both the front-rear direction and the up-down direction of the holding member 505.

(Moving Mechanism)

In the following, the moving mechanism 640 for moving the optical print head 105 will be described.

Figure 9:
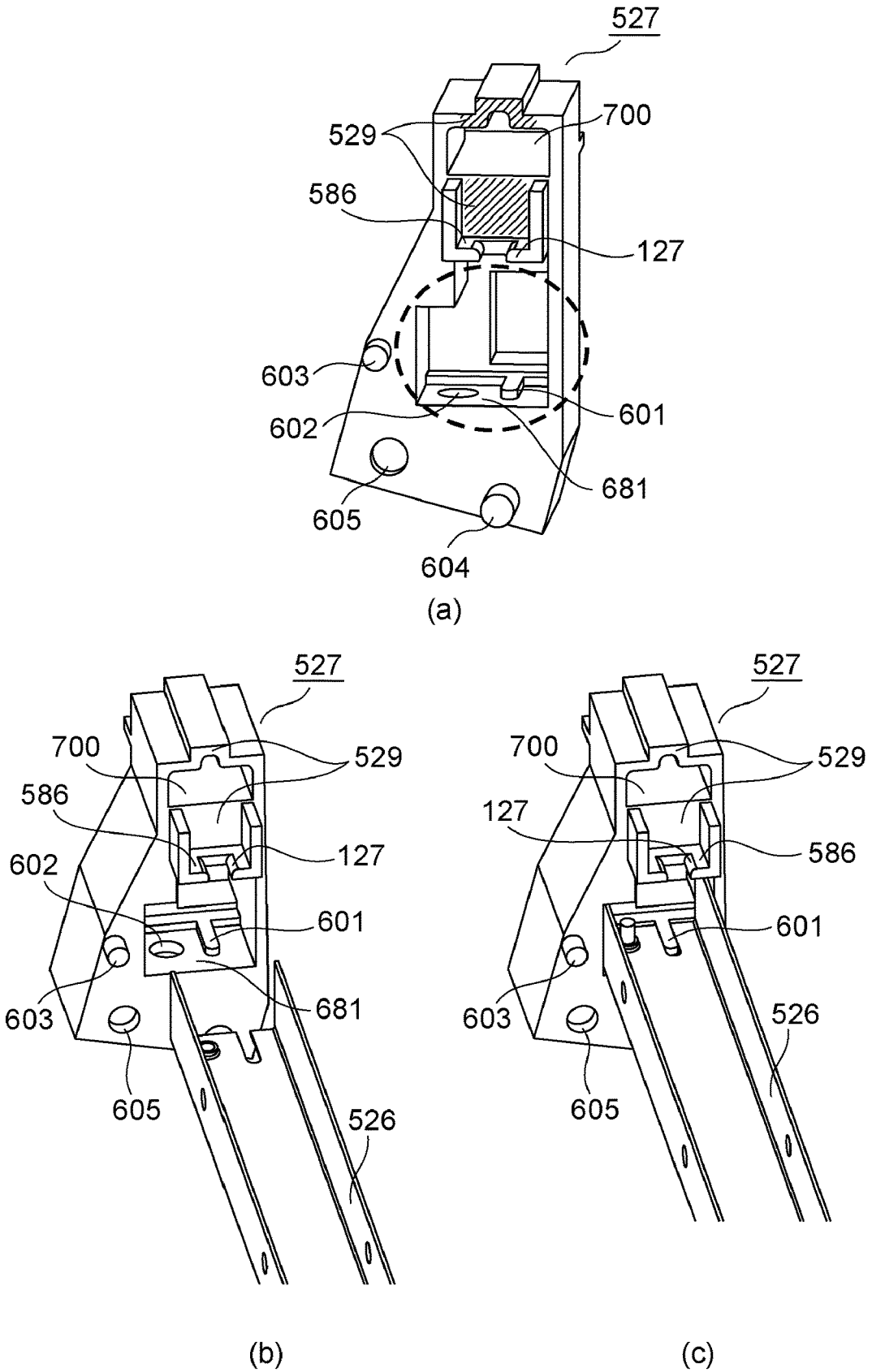
FIG. 9 includes perspective views of a first supporting portion and a third supporting portion.

First, the first supporting portion 527 will be described. Part (a) of FIG. 9 is a schematic perspective view of the first supporting portion 527. At the first supporting portion 527, the first bearing surface 586 as an example of an abutting portion (stopping mechanism), an opening 700 as an example of an inserting portion, a contact portion 529, the regulating portion 127, a projection 601, a screw hole 602, a positioning boss 603, a positioning boss 604 and a screw hole 605 are formed. Here, the first supporting portion 527 may also be molded product prepared by integrally subjecting the opening 700 and the first bearing surface 586 to injection molding or may also be separate members of these portions.

The first bearing surface 586 is a portion to which the lower side of the holding member 505 moving from the exposure position toward the retracted position is contacted from the upper side with respect to the vertical direction, and is fixed to the image forming apparatus 1 main assembly. The lower side of the holding member 505 contacts the first bearing surface 586, so that the optical print head 105 is in the retracted position.

Into the opening 700, a cleaning member 572 for cleaning the light emitting surface of the lens array 506 contaminated with the toner or the like is inserted from an outside of the image forming apparatus 1 main assembly. The cleaning member 572 is an elongated rod-like member. In this embodiment, as an example of the opening 700, a through hole through which the cleaning member 572 penetrates in the front-rear direction is shown, but the opening 700 is not limited to the through hole, but for example, a slit may also be formed at an upper portion. The contact portion 529 is a rear side surface of the first supporting portion 527 shown by a hatched line in part (b) of FIG. 9 and includes upper side and lower side regards the opening 700. As regards a function of the contact portion 529, details will be described later.

As shown in part (a) of FIG. 9, the regulating portion 127 is a U-shaped recessed portion which is formed in the regulating portion 527 and which opens toward the rear side. A part of the contact pin 514 projecting from the lower side of the holding member 505 moves up and down together with the holding member 505 in a gap formed by the regulating portion 127. The regulating portion 127 has a tapered shape for reducing a frictional force, to the extent possible, generated by contact with the contact pin 514, and a thickness with respect to the up-down direction becomes thin toward the contact pin 514. By this, the contact pin 514 can smoothly move up and down in the gap of the regulating portion 127.

The first supporting portion 527 is fixed to the front side surface of the front side plate 642. The front side plate 642 is provided with a positioning boss 603, a positioning boss 604 and a plurality of holes corresponding to fixing screws, respectively (not shown). The positioning boss 603 and the positioning boss 604 are inserted in a plurality of holes provided, and in that state, the first supporting portion 527 is fixed to the front side plate 642 by screws passed through the screw holes of the first supporting portion 527.

The third supporting portion 526 described later is a metal plate bent in a U-shape. Part (b) of FIG. 9 shows a view for illustrating a state in which one end portion of the third supporting portion 526 with respect to the longitudinal direction is to be inserted into a portion enclosed by a dotted line shown in part (a) of FIG. 9, and part (c) of FIG. 9 is a view in which the one end portion of the third supporting portion 526 with respect to the longitudinal direction in the portion enclosed by the dotted line shown in part (a) of FIG. 9. As shown in parts (b) and (c) of FIG. 9, the one end portion of the third supporting portion 526 is provided with a cut-away portion, and the projection 601 on the first supporting portion 527 side engages with the cut-away portion of the third supporting portion 526. By engagement of the projection 601 with the cut-away portion of the third supporting portion 526, a position of the third supporting portion 526 with respect to the left-right direction is determined relative to the first supporting portion 527. The third supporting portion 526 is pressed from a lower side of part (c) of FIG. 9 by a screw inserted through the screw hole 602 and is fixed to the first supporting portion 527 by contact thereof with a contact surface 681 of the first supporting portion 527.

Figure 10:
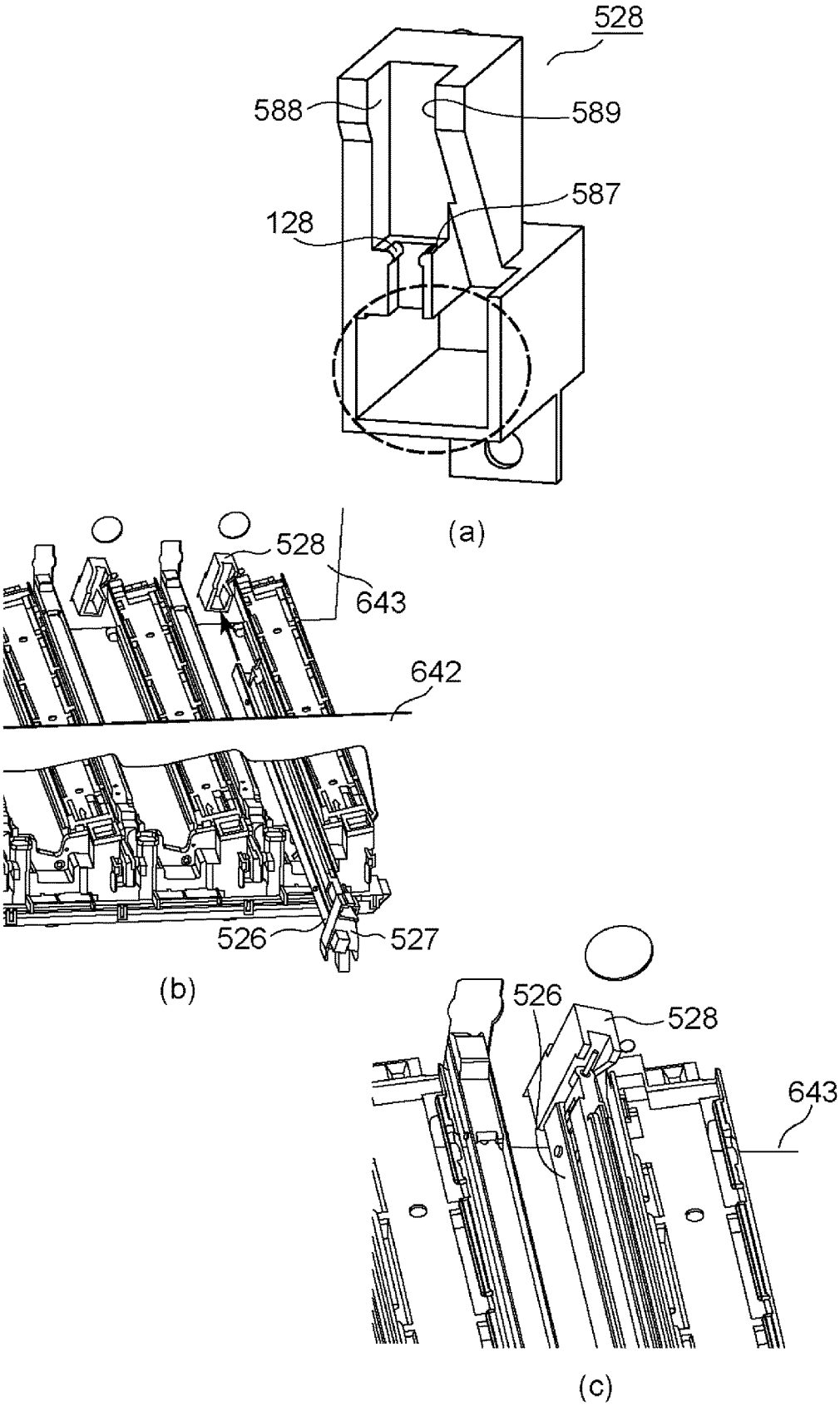
FIG. 10 includes perspective views of a second supporting portion, a rear side plate, and an exposure unit mounted to the second supporting portion.

Next, the second supporting portion 528 will be described. Part (a) of FIG. 10 is a schematic perspective view of the second supporting portion 528. At the second supporting portion 528, a second bearing surface 587, a first wall surface 588, a second wall surface 589 and the regulating portion 128 are formed.

The second bearing surface 587 is, as described above, a portion to which the lower side of the holding member 505 moving from the exposure position toward the retracted position contacts. The second bearing surface 587 is fixed to the image forming apparatus 1 main assembly. The lower side of the holding member 505 contacts the second bearing surface 587, so that the optical print head 105 is in the retracted position.

As shown in part (b) of FIG. 10, the second supporting portion 528 is fixed to the front side surface of the rear side plate 643. The second supporting portion 528 is fixed to the rear side plate 643 by positioning bosses and screws similarly as the method in which the first supporting portion 527 is fixed to the front side plate 642. Part (c) of FIG. 10 shows a state in which the other end side (rear side) of the third supporting portion 526 with respect to the longitudinal direction of the third supporting portion 526 is inserted in a portion enclosed by a dotted line shown in part (a) of FIG. 10. That is, the third supporting portion 526 is supported by the first supporting portion 527 at one end portion and is supported by the second supporting portion 528 at the other end portion, and the first supporting portion 527 and the second supporting portion 528 are fixed to the front side plate 642 and the rear side plate 643, respectively. For that reason, the third supporting portion 526 is fixed to the image forming apparatus 1 main assembly.

Incidentally, the second supporting portion 528 may also have a constitution in which the second supporting portion 526 is fixed to the third supporting portion 526 by the screws or the like and is not screwed with the rear side plate 643. In that case, for example, the second supporting portion 526 has a structure such that a recessed portion is formed and is engaged with a projection formed on the rear side plate 643, and a position of the second supporting portion 528 relative to the rear side plate 643 is determined. The first wall surface 588 and the second wall surface 589 of the second supporting portion 528 will be described later.

Figure 14:
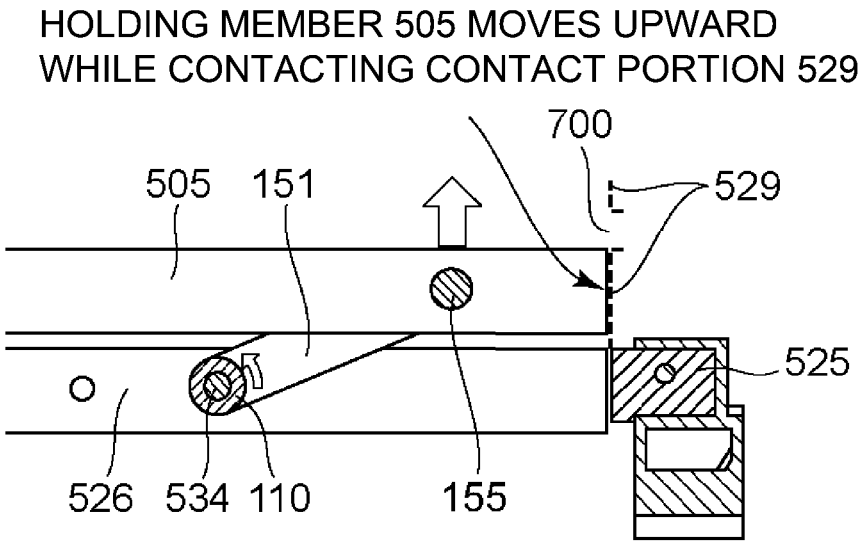
FIG. 14 includes views for illustrating a moving mechanism.
Figure 14:
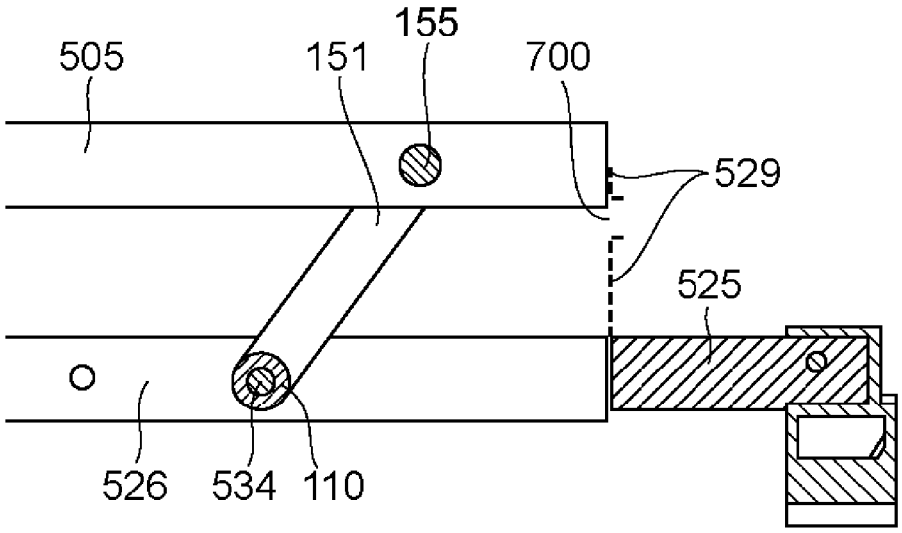

As shown in part (a) of FIG. 14, the regulating portion 128 is a U-shaped recessed portion which is formed in the regulating portion 528 and which opens toward the front side. A part of the contact pin 515 projecting from the lower side of the holding member 505 moves up and down together with the holding member 505 in a gap formed by the regulating portion 128. The regulating portion 128 has a tapered shape for reducing a frictional force, to the extent possible, generated by contact with the contact pin 515, and a thickness with respect to the up-down direction becomes thin toward the contact pin 515. By this, the contact pin 515 can smoothly move up and down in the gap of the regulating portion 128.

Next, the third supporting portion 526 and the slidable portion 525 will be described using FIG. 11. The third supporting portion 526 and the slidable portion 525 are disposed on a side opposite from the photosensitive drum 103 with respect to the holding member 505.

Figure 11:
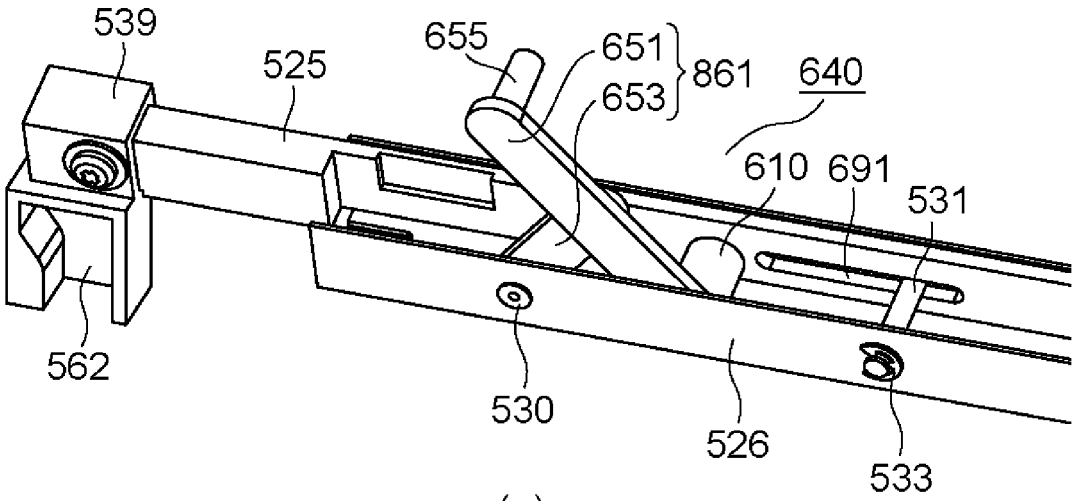
FIG. 11 includes perspective views of a moving mechanism for which the first supporting portion is not shown.
Figure 11:
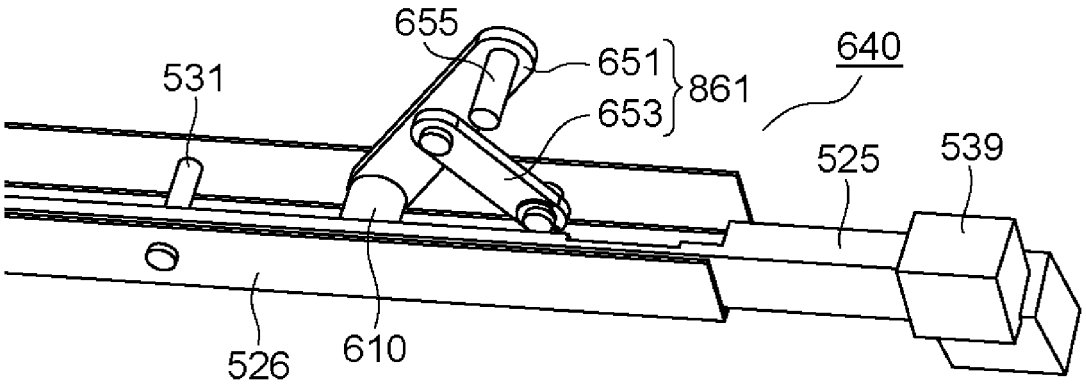

Part (a) of FIG. 11 is a schematic perspective view of the moving mechanism 640, in which the first supporting portion 527 is not shown, when a front side of the moving mechanism 640 is seen from a left side, and part (b) of FIG. 11 is a schematic perspective view of the moving mechanism 640, in which the first supporting portion 527 is not shown, when a rear side of the moving mechanism 640 is seen from a right side. The moving mechanism 640 includes the link member 651, the slidable portion 525 and the third supporting portion 526. The third supporting portion 526 includes a supporting shaft 531 and an E-shaped stopper ring 533. As shown in FIG. 11, the supporting shaft 531 is inserted through openings provided in surfaces (left side surface and right side surface) which opposes with respect to the left-right direction of the third supporting portion 526 processed in a U-character shape. The supporting shaft 531 penetrates through the left side surface and the right side surface of the third supporting portion 526. The supporting shaft 531 is retained by the E-shaped stopper ring 533 on an outside of the left side surface so as not to be disconnected through the opening of the third supporting portion 526. On the other hand, as shown in part (a) of FIG. 15, the slidable portion 525 is provided with an elongated hole 691 extending in the front-rear direction. The supporting shaft 531 is inserted into the elongated hole 691 of the slidable portion 525 and is loosely engaged in the elongated hole 691 with a gap of, e.g., about 0.1-0.5 mm with respect to the up-down direction. For that reason. Movement of the slidable portion 525 relative to the third supporting portion 526 in the up-down direction is restricted, and the slidable portion 525 is slidable (movable) relative to the third supporting portion 526 correspondingly to a length of the elongated hole 691 with respect to the front-rear direction.

Further, an one end side of the slidable portion 525, a slide assisting portion 539 including an accommodating space 562 ranging from a left side to a lower side is mounted. The slide assisting portion 539 is fixed to the slidable portion 525 from the left side through fastening with a screw. In the accommodating space 562, a pressing portion 561 as an example of an urging portion provided in a cover 558 described later is accommodated. A relationship between the accommodating space 562 and the pressing portion 561 and structural features of these will be described together with description as to the cover 558 described later.

In the following, the moving mechanism 640 will be described using FIG. 3, FIG. 11 and FIG. 12.

FIG. 3 is a schematic perspective view of the exposure unit 500 including the moving mechanism 640. As shown in FIG. 3, the moving mechanism 640 includes a first link mechanism 861, a second link mechanism 862, the slidable portion 525, the first supporting portion 527, the second supporting portion 528 and the third supporting portion 526. The first link mechanism 861 includes the link member 651 and the link member 653, and the second link mechanism 862 includes the link member 652 and the link member 654. As shown in FIG. 3, the link member 651 and the link member 653, and the link member 652 and the link member 654 constitute link mechanisms of a λ type, respectively.

Figure 15:
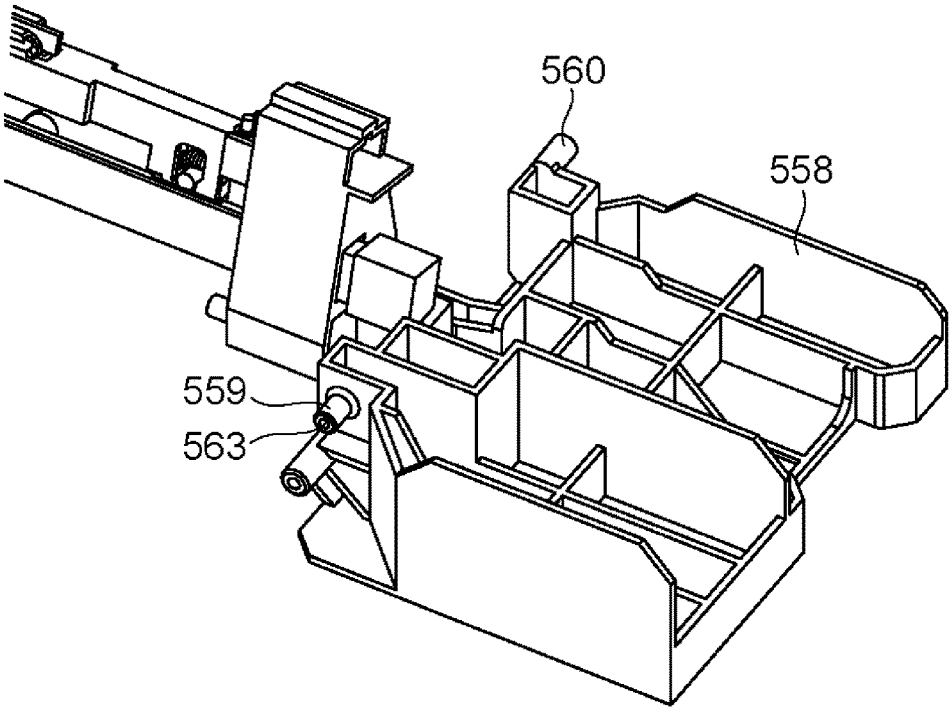
FIG. 15 includes perspective views of a cover.
Figure 15:
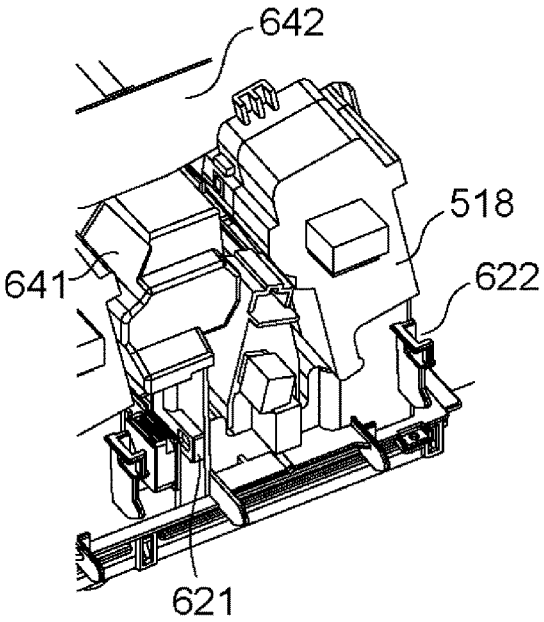
Figure 15:
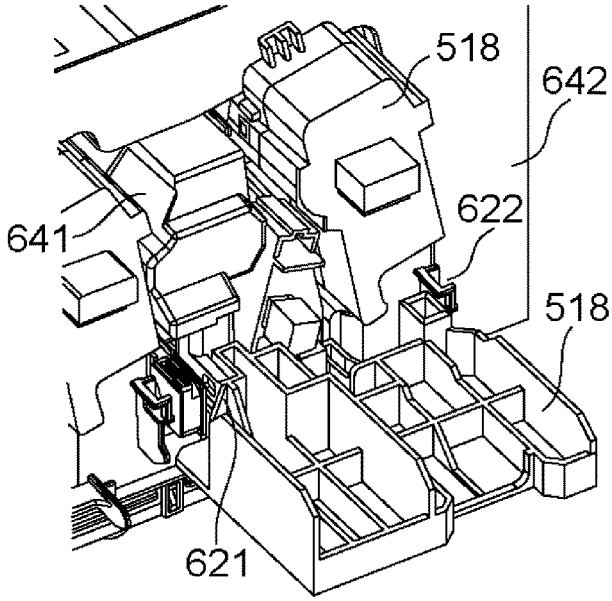

Part (a) of FIG. 11 is a schematic perspective view of the front side of the moving mechanism 640, in which the first supporting portion 527 is not shown, as seen from a left side. Further, part (b) of FIG. 15 is a schematic perspective view of the front side of the moving mechanism 640, in which the first supporting portion 527 is not shown, as seen from a right side.

In the following, the first link mechanism 861 will be described using part (a) of FIG. 11, part (b) of FIG. 11, part (a) of FIG. 12 and part (b) of FIG. 12. Part (a) of FIG. 12 is a schematic view of a cross-sectional view of the first link mechanism 861 cut along the rotational axis direction as seen from the right side. The first link mechanism 861 includes the link member 651 and the link member 653. Each of the link member 651 and the link member 653 is a single link member, but may also be constituted by combining a plurality of link members.

Figure 12:
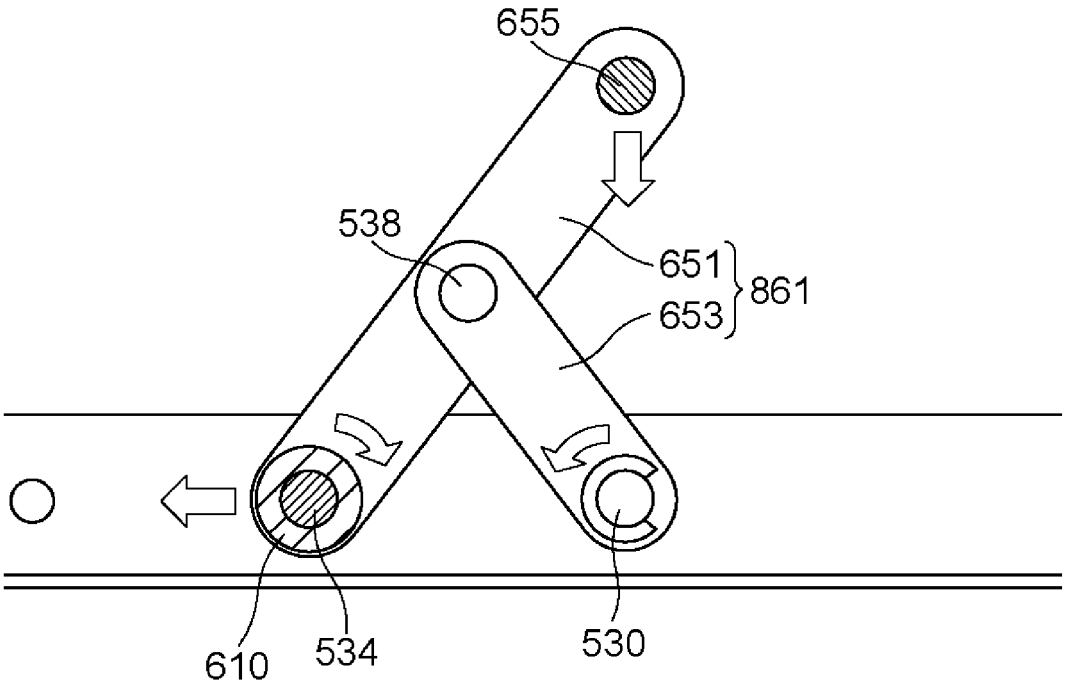
FIG. 12 includes side views of a first link mechanism of a λ type.
Figure 12:
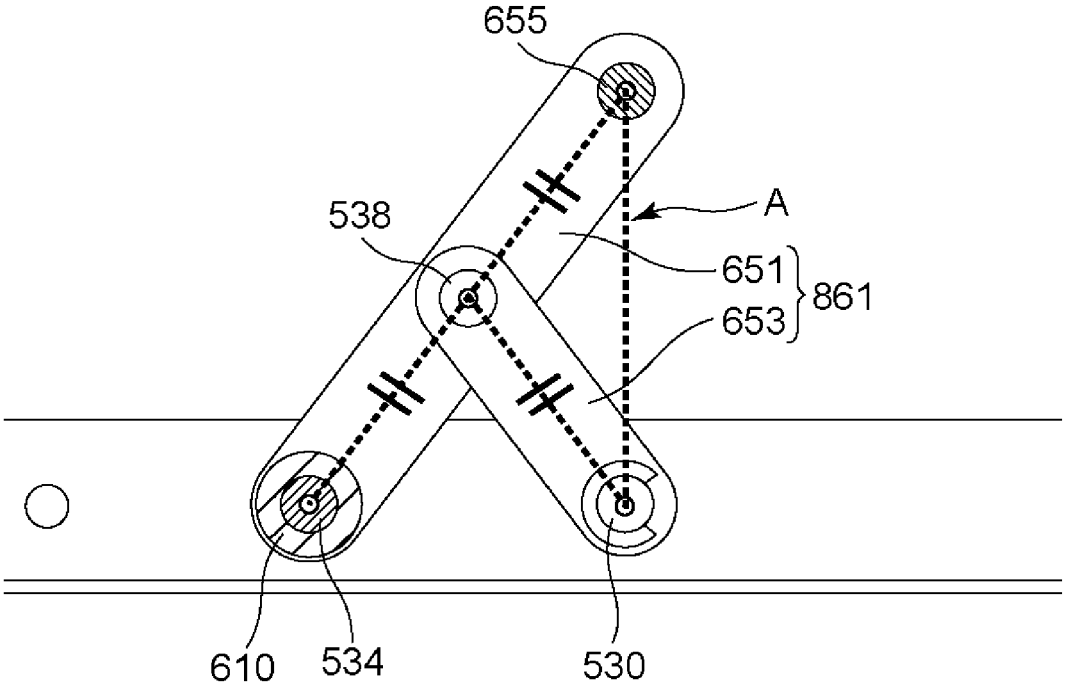

As shown in parts (a) and (b) of FIG. 12, a length of the link member 653 with respect to the longitudinal direction is shorter than a length of the link member 651 with respect to the longitudinal direction.

The link member 651 includes a bearing portion 610, a projection 655 and a connecting shaft portion 538. The bearing portion 610 is provided on one end side of the link member 651 with respect to the longitudinal direction. The projection 655 is a cylindrical projection provided on the other end side of the link member 651 with respect to the longitudinal direction and standing in the rotational axis direction of the link member 651, and is a projection for deforming a spring provided on the holding member 505 side of the optical print head 105. The connecting shaft portion 538 is provided between the bearing portion 610 and the projection 655 with respect to the longitudinal direction of the link member 651. Incidentally, the link member 651 is not limited to the link member including the projection 655, but may also have a structure in which the link member 651 is bent with respect to the rotational axis direction on one end side with respect to the longitudinal direction.

The bearing portion 610 is provided with a hollow hole extending in the left-right direction of part (a) of FIG. 12. The slidable portion 525 is provided with an engaging shaft portion 534. The engaging shaft portion 534 is a cylindrical projection standing from the slidable portion 525 in the left direction of part (a) of FIG. 12. The engaging shaft portion 534 forms a first connecting portion by being engaged rotatably in the hole of the bearing portion 610. That is, the link member 651 is rotatable about the first connecting portion relative to the slidable portion 525. Here, a constitution in which the engaging shaft portion 534 is formed on the link member 651 side and in which the bearing portion 610 is formed on the slidable portion 525 side may also be employed.

The link member 653 includes a connecting shaft portion 530. The connecting shaft portion 530 is provided on one end side of the link member 653 with respect to the longitudinal direction of the link member 653. The connecting shaft portion 530 is a cylindrical project standing from the link member 653 toward the left side of part (a) of FIG. 12. The connecting shaft portion 530 is inserted rotatably in a hole formed in the third supporting portion 526 and forms a second connecting portion. Here, the connecting shaft portion 530 may also be formed on the third supporting portion 526, not the link member 653. That is, in the hole provided in the link member 653, the connecting shaft portion 530 formed on the third supporting portion 526 may also be inserted.

The link member 653 is provided with a circular hole, extending in the left-right direction of part (a) of FIG. 12, formed on the other end side thereof with respect to the longitudinal direction. In the hole, the connecting shaft portion 538 of the link member 651 is rotatably inserted, so that the connecting shaft portion 538 and the hole of the link member 653 form a fourth connecting portion. That is, the link member 653 is rotatable about the third connecting portion relative to the third supporting portion 526 and is rotatable about the fourth connecting portion relative to the link member 651. Here, the connecting shaft portion 538 may also be formed on the link member 653, not the link member 651. That is, the connecting shaft portion 538 formed on the link member 653 may also be rotatably inserted in a hole formed in the link member 651.

Incidentally, a structure of the second link mechanism 862 is also similar to the above-described structure of the first link mechanism 861. The link members 652 and 654 of the second link mechanism 862 correspond to the link members 651 and 653, respectively. Correspondingly to the first connecting portion, connecting portion between one end side portion of the link member 652 with respect to the longitudinal direction and the slidable portion 525 constitutes a second connecting portion. On the link member 652, a projection 656 corresponding to the projection 655 of the link member 651 is formed. Incidentally, in the moving mechanism 640, either one of the link members 653 and 654 may also be omitted.

By the above constitution, when the slidable portion 525 is slid from the front side toward the rear side relative to the third supporting portion 526, the bearing portion 610 engaged with the engaging shaft portion 534 is slid together with the slidable portion 525 from the front side toward the rear side relative to the third supporting portion 526. By this, as shown in part (a) of FIG. 16, when the first link mechanism 861 is seen from the rear side, the first link mechanism 861 is rotated about the engaging shaft portion 534 in the clockwise direction, and the link member 653 is rotated about the connecting shaft portion 530 in the counterclockwise direction. Therefore, the projection 655 is moved from the exposure position toward a retracted position.

On the other hand, when the slidable portion 525 is slid (moved) from the rear side toward the front side relative to the third supporting portion 526, the link member 651 and the link member 653 are moved in a direction opposite to the arrow direction shown in part (a) of FIG. 12. When the slidable portion 525 is slid from the rear side toward the front side relative to the third supporting portion 526, the bearing portion 610 engaged with the engaging shaft portion 534 is slid together with the slidable portion 525 from the rear side toward the front side relative to the third supporting portion 526. As a result, as shown in part (a) of FIG. 12, when the first link mechanism 861 is seen from the right side, the first link mechanism 861 is rotated about the engaging shaft portion 534 in the counterclockwise direction, and the link member 653 is rotated about the connecting shaft portion 530 in the clockwise direction. Therefore, the projection 655 is moved from the retracted position toward the exposure position.

Incidentally, (1) a distance between a rotation center axis of the connecting shaft portion 538 and a rotation center axis of the bearing portion 610 is L1, (2) a distance between the rotation center axis of the connecting shaft portion 538 and a rotation center axis of the connecting shaft portion 530 is L2, and (3) a distance between the rotation center axis of the connecting shaft portion 538 and a rotation center axis of the projection 655 is L3. In the moving mechanism 640, the first link mechanism 861 forms Scott-Russel's mechanism in which L1, L2 and L3 are equal to each other (part (b) of FIG. 12). The distances L1, L2 and L3 are made equal to each other, whereby the projection 655 is vertically moved (along a dotted line A in part (b) of FIG. 12) with respect to a slide (movement) direction of the engaging shaft portion 534, and therefore, in the above-described link mechanism, the optical print head 105 can be moved substantially in an optical axis direction of the lens.

Here, a constitution in which a structure in which the first link mechanism 861 and the second link mechanism 862 are reversed with respect to the front-rear direction, is used and when the slidable portion 525 is slid from the front side toward the rear side, the optical print head 105 is moved from the retracted position toward the exposure position, and when the slidable portion 525 is slid from the rear side toward the front side, the optical print head 105 is moved from the exposure position toward the retracted position may also be employed. In this case, the cover 558 described later pushes the slidable portion 525 from the front side toward the rear side during movement of the cover 558 from an open state toward a closed state and pulled the slidable portion 525 from the rear side toward the front side during movement of the cover 558 from the closed state toward the open state.

Figure 13:
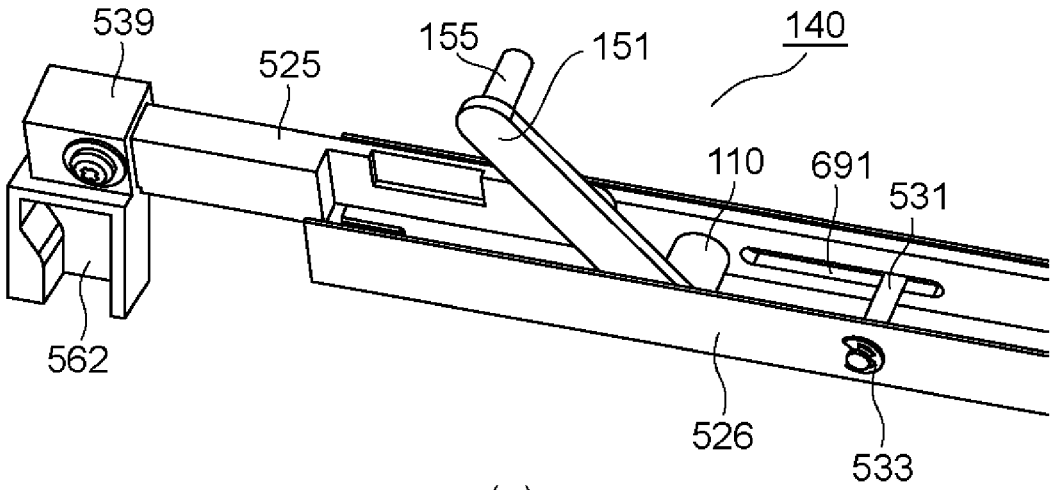
FIG. 13 includes schematic perspective views of the exposure unit.
Figure 13:
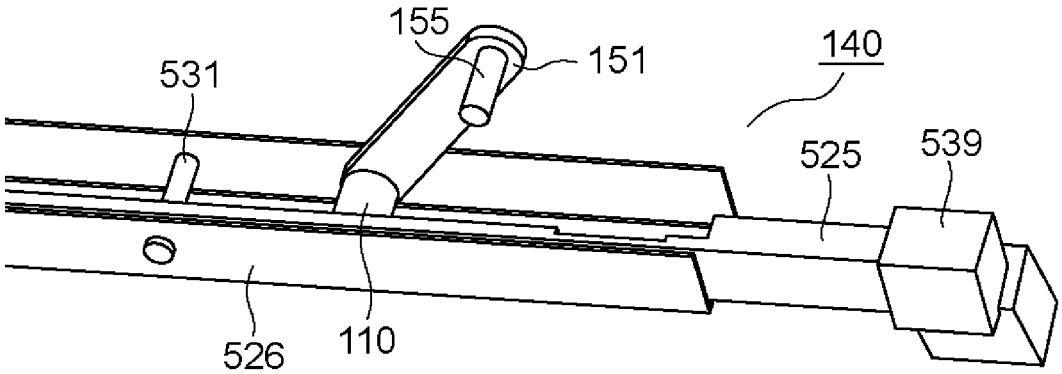

The mechanism for moving the optical print head 105 is not limited to the moving mechanism 640 but may also be a moving mechanism 140 shown in FIG. 13. In the following, the moving mechanism 140 will be described using FIG. 13 and FIG. 14. Incidentally, members having functions substantially similar to the members constituting the moving mechanism 640 are described by adding thereto the same reference numerals or symbols and will be omitted from redundant description in some cases.

In the following, a mechanism in which the moving mechanism 140 moves the holding member 505 will be described using part (a) of FIG. 13, part (b) of FIG. 13, part (a) of FIG. 14 and part (b) of FIG. 14. Part (a) of FIG. 14 is a sectional view of the holding member 505 and the moving mechanism 140 shown in part (b) of FIG. 14, which are cut along a plane along the rotational axis of the photosensitive drum 103.

As shown in parts (a) and (b) of FIG. 13, a link member 151 includes a bearing portion 110 and a projection 155. The bearing portion 110 is provided on one end side of the link member 151 with respect to the longitudinal direction. As shown in parts (a) and (b) of FIG. 14, the projection 155 is a cylindrical projection provided on the other end side of the link member 151 with respect to the longitudinal direction and standing in the rotational axis direction of the link member 151, and is a projection for deforming a spring provided on the holding member 505 side of the optical print head 105. Here, the link member 151 is not limited to the link member including the projection 155, but may also be a structure in which the link member 151 is bent with respect to the rotational axis direction of the link member 151 on one end side with respect to the longitudinal direction of the link member 151.

The bearing portion 110 is provided with a hollow hole extending in the left-right direction. As shown in parts (a) and (b) of FIG. 14, the slidable portion 525 is provided with an engaging shaft portion 534. The engaging shaft portion 534 is a cylindrical projection standing from the slidable portion 525 in the left direction. The hole of the bearing portion 110 forms a first connecting portion by being engaged rotatably with the engaging shaft portion 534. That is, the link member 151 is rotatable about the first connecting portion relative to the slidable portion 525. Here, a constitution in which the engaging shaft portion 534 is formed on the link member 151 side and in which the bearing portion 110 is formed on the slidable portion 525 side may also be employed.

Incidentally, on the rear side of the third supporting portion 526, a shaft similar to the supporting shaft 531 is provided, and on the rear side of the slidable portion 525, an elongated hole similar to the elongated hole 691 is formed, and the rear side of the moving mechanism 140 has a structure similar to the structure of the front side. A structure of the link member 152 is also similar to the structure of the link member 151. Further, correspondingly to the first connecting portion, a connecting portion between one end side of the link member 152 with respect to the longitudinal direction and the slidable portion 525 constitutes a second connecting portion.

On a side in front of one end of the holding member 505, the contact portion 529 of the first supporting portion 527 (not shown) is disposed. By this, when the slidable portion 525 slides (moves) from the rear side toward the front side relative to the third supporting portion 526, the bearing portion 110 engaging with the engaging shaft portion 534 slides (moves) together with the slidable portion 525 from the rear side toward the front side relative to the third supporting portion 526. With that, the holding member 505 on which the projection 155 is mounted will move toward the front side, but the one end of the holding member 505 contacts the contact portion 529, so that movement of the holding member 505 toward the projection side is restricted. The link member 151 is disposed so as to cross the rotational axis direction of the photosensitive drum 103 so that one end side where the projection 155 is provided is positioned on the drum unit 518 side than the other end side where the bearing portion 110 is provided is, and therefore, when the link member 151 is seen from the right side as shown in part (a) of FIG. 14, the link member 151 is rotated (rotationally moved) counterclockwise about the engaging shaft portion 534 as a rotation center. Therefore, the holding member 505 moves from the retracted position toward the exposure position while contacting the contact portion 529 at one end thereof.

On the other hand, when the slidable portion 525 slides (moves) from the front side toward the rear side relative to the third supporting portion 526, the bearing portion 110 engaging with the engaging shaft portion 534 slides (moves) together with the slidable portion 525 from the rear side toward the front side relative to the third supporting portion 526. By this, the link member 151 rotates clockwise about the engaging shaft portion 534 as seen from the light side as shown in part (a) of FIG. 14. Therefore, the projection 155 moves in a direction from the exposure position toward the retracted position. Although specifically described later, the slidable portion 525 moves from the rear side toward the front side in interrelation with a closing operation of the cover 558 and moves from the front side toward the rear side in interrelation with an opening operation of the cover 558. That is, when the cover 558 moves from an open state to a closed state, the holding member 505 moves in the direction from the retracted position toward the exposure position, and when the cover 558 moves from the closed state to the open state, the holding member 505 moves in the direction from the exposure position toward the retracted position.

When the optical print head 105 moves in substantially the optical axis direction of the lenses, the rear side of the holding member 505 moves in the gap formed by the first wall surface 588 and the second wall surface 589 provided in the above-described second supporting portion 528. By this, inclination of the holding member 505 with respect to the left-right direction is prevented.

The link member 151 and the link member 152 may also be disposed so that the other end side is disposed on the front side than the other end side is, and the contact portion 529 may also be disposed on the rear side than the other end of the holding member is. That is, when the slidable portion 525 slides (moves) from the front side toward the rear side relative to the third supporting portion 526, the bearing portion 110 engaging with the engaging shaft portion 534 slides (moves) together with the slidable portion 525 from the front side toward the rear side relative to the third supporting portion 526. With that, the holding member 505 on which the projection 155 is mounted will move toward the rear side, but the other end of the holding member 505 contacts the contact portion 529, so that movement of the holding member 505 toward the projection side is restricted. When the link member 151 is seen from the right side, the link member 151 and the link member 152 are rotated (rotationally moved) clockwise about the engaging shaft portion 534 as a rotation center, so that the holding member 505 moves from the retracted position toward the exposure position while contacting the contact portion 529 at the other end thereof. In this case, the cover 558 pushes the slidable portion 525 from the front side toward the rear side during movement thereof from the open state toward the closed state and pulls the slidable portion 525 from the rear side toward the front side during movement thereof from the closed state toward the open state.

Part (a) of FIG. 15 is a perspective view of the cover 558. As shown in part (a) of FIG. 15, the cover 558 includes a rotation shaft portion 559 and a rotation shaft portion 560. The rotation shaft portion 559 is a cylindrical projection projecting in the right side direction of the cover 558. On the other hand, the rotation shaft portion 560 is a cylindrical projection projecting in the left side direction of the cover 558.

An enlarged view of a portion where the cover 558 is mounted on the front side plate 642 is shown in part (b) of FIG. 15. Further, part (c) of FIG. 15 is a perspective view of the cover 558 mounted on the front side plate 642. As shown in part (b) of FIG. 15, the front side plate 642 includes a bearing member 621 engageable with the rotation shaft portion 559 of the cover 558 and includes a bearing member 622 engageable with the rotation shaft portion 560 of the cover 558. As shown in part (c) of FIG. 15, the rotation shaft portion 559 of the cover 558 rotatably engages with the bearing member 621 of the front side plate 642, and the rotation shaft portion 560 of the cover 558 rotatably engages with the bearing member 622 of the front side plate 642. As shown in part (a) of FIG. 15, a rotational axis of the rotation shaft portion 559 and a rotational axis of the rotation shaft portion 560 are on the same axis (rotational axis 563). The rotational axis 563 is positioned on a lower side with respect to the vertical direction than the rotational axis of the photosensitive drum 103 is. The cover 558 rotates about and is openable and closable about the rotational axis 563 as a rotation center relative to the image forming apparatus 1 main assembly. The cover 558 moves between a closed state (closed position) in which the cover 558 is closed for closing a movement passage when the drum unit 518 and the developing unit 641 are exchanged and an open state (open position) in which the cover 558 is opened for ensuring the movement passage. For that reason, when the cover 558 is in a closed state, the operator cannot perform the exchange operation of the drum unit 518 and the developing unit 641. The operator is capable of exchanging the drum unit 518 by opening the cover 558, and closes the cover 558 after the operation.

Next, using FIG. 16-FIG. 19, a constitution in which the slidable portion 525 slides (moves) in the rotational axis direction of the photosensitive drum 103 in interrelation with the opening and closing operation of the cover 558 (rotatable member) will be specifically described while making a comparison with a constitution of the front cover 5 disclosed in JP-A 2013-134370.

In JP-A 2031-134370, the constitution in which the slidable portion 525 moves in the front-rear direction corresponding to rotation of the front cover 5 and the holding member 63 moves in the up-down direction is disclosed.

Here, when the drum unit 10 is exchanged, in order to prevent contact of the drum unit 10 with the LED array 50, it is desirable that the LED array 50 is capable of being spaced away from the photosensitive drum 15 to the extent possible. That is, it is ideal that the compression spring 54 is short to the extent possible. The compression spring 54 becomes short in spring pitch when the positioning roller 53 contacts the photosensitive drum 15, with a shorter full length if the number of windings is the same. In a state in which the positioning roller 53 contacts the photosensitive drum 15, correspondingly to the rotation of the front cover 5, the holding member 63 approaches the first frame 51 depending on the rotation, so that the compression spring 54 is compressed (deformed). The front cover 5 is completely closed, and by a restoring force of the compression spring 54 in a compressed state, the positioning roller 53 is pressed toward the photosensitive drum 15. In this embodiment, the contact pin 514 which is a member corresponding to the positioning roller 53 disclosed in JP-A 2013-134370 is pressed toward the drum unit 518 with a force (spring pressure) of 350 g weight by the coil spring 547. Here, in this embodiment, the above-described spring pressure may be within a range of ± about 30% relative to 350 g weight which is an ideal value in consideration of a tolerance of component parts, i.e., within a range of 250 g weight-450 g weight. A force for urging the drum unit 518 by the contact pin 514 (515) closely relates to flexure of the substrate 502 and the lens array 506. However, due to tolerance of component parts such as the link member 151, the link member 152 and the slidable portion 525, when the cover 558 is completely closed, a possibility that the force for urging the drum unit 518 by the contact pin 514 (515) exceeds or is below the range of 250-450 g weight is nonnegligible. Therefore, in this embodiment, as described later (part (c) of FIG. 16 and part (c) of FIG. 17), a constitution in which the cover 558 is gradually closed and after the optical print head 105 moves to the exposure position, a slide movement amount of the slidable portion 525 with the rotation of the cover 558 is suppressed is employed.

Figure 16:
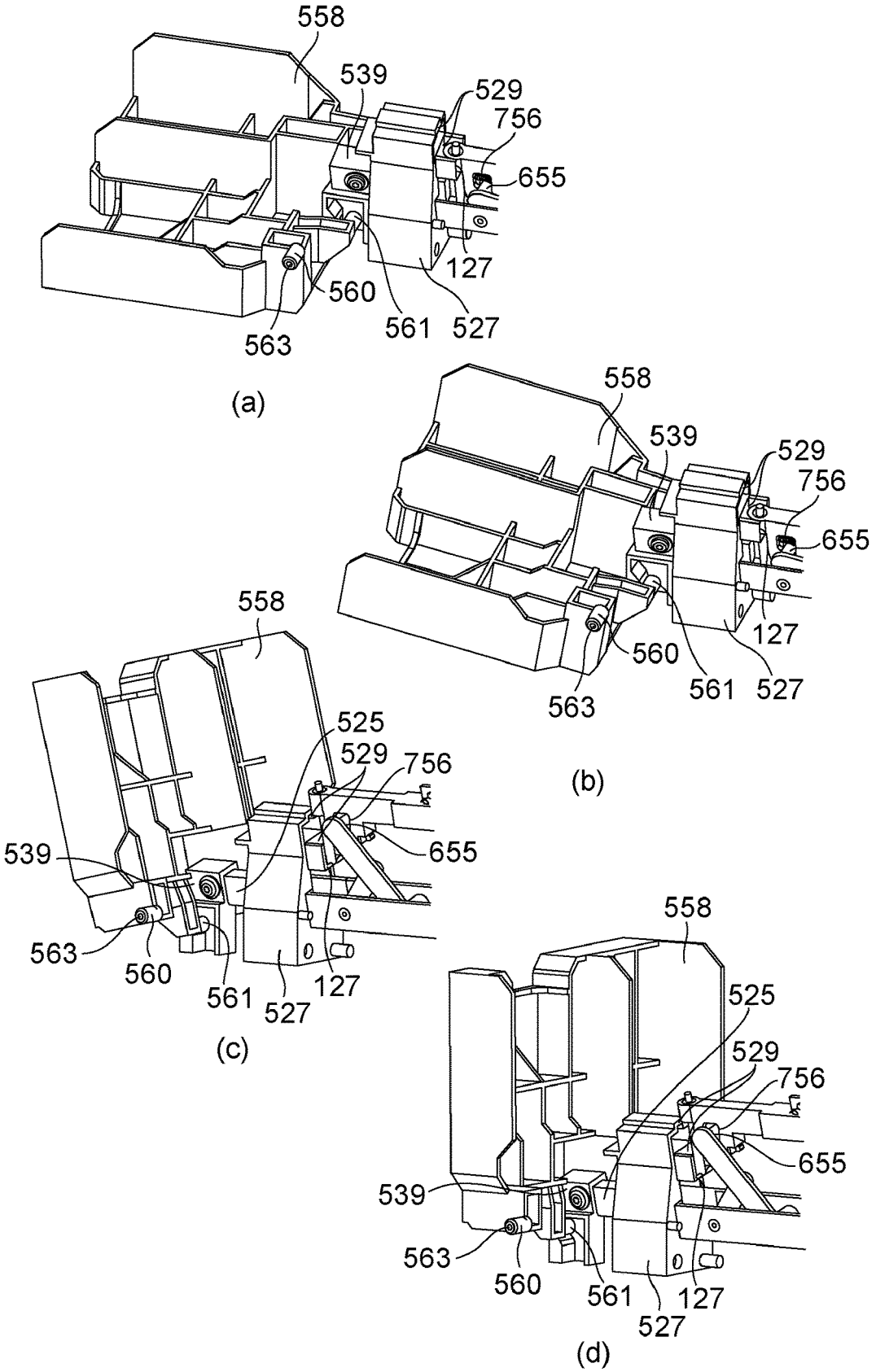
FIG. 16 includes perspective views of the cover for illustrating an operation when the cover is closed.
Figure 17:
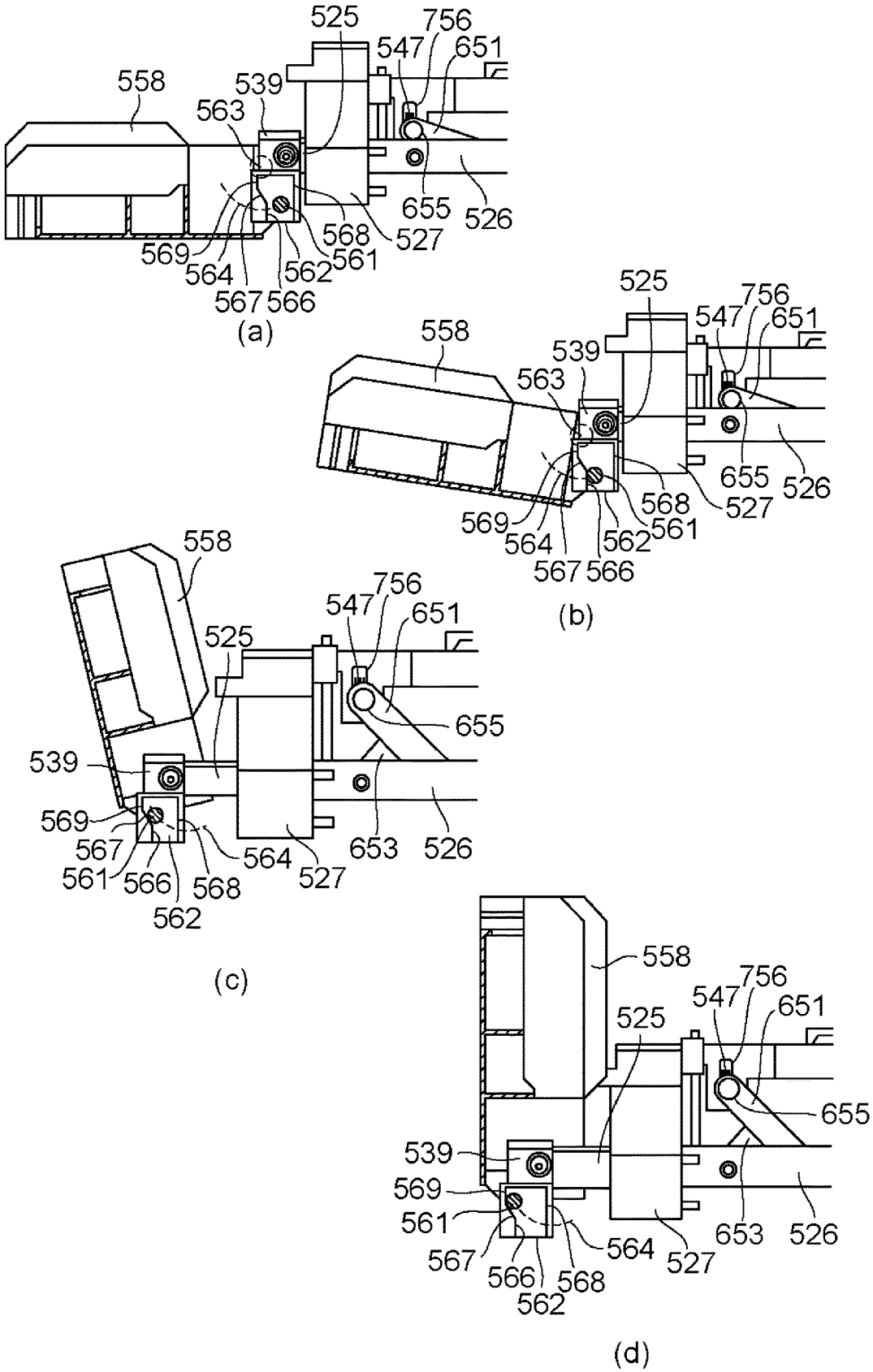
FIG. 17 includes perspective views of the cover for illustrating the operation when the cover is closed.

Parts (a)-(d) of FIG. 16 are perspective views showing the cover 558 rotating from the open state toward the closed state. Parts (a)-(d) of FIG. 17 are sectional views showing the cover 558 rotating from the closed state toward the open state. Part (a) of FIG. 16 and part (a) of FIG. 17 show the open state of the cover 558. Part (d) of FIG. 16 and part (d) of FIG. 17 show the closed state of the cover 558. Part (b) of FIG. 16 and part (b) of FIG. 17, and part (c) of FIG. 16 and part (c) of FIG. 17 are the views showing the cover 558 shifting from the open state to the closed state. Incidentally, the cover 558 in the closed state shown in part (d) of FIG. 16 and part (d) of FIG. 17 maintains the closed state by a snap-fit mechanism, a stopper for preventing rotation, or the like.

As shown in parts (a)-(d) of FIG. 15, the cover 558 rotates about the rotational axis 563 as a center relative to the image forming apparatus 1 main assembly. The cover 558 is provided with the pressing portion 561 (urging portion) moving about the rotational axis 563 on the lower side than the rotational axis 563 is. The pressing portion 561 is, for example, a cylindrical projection and projects from the left side toward the right side of the cover 558, and is positioned in the accommodating space 562 mounted at one end of the slidable portion 525. Further, the pressing portion 561 moves on a part (movement focus 564), on a circle about the rotational axis 563 with rotation of the cover 558 as shown in parts (a)-(d) of FIG. 17. When the cover 558 is in the open state, the pressing portion 561 is positioned on the rear side than the rotational axis 563 is, and when the cover 558 is in the closed state, the pressing portion 561 is positioned on the front side than the rotational axis 563 is. Further, the position of the pressing portion 561 when the cover 558 is in the closed state is positioned on the photosensitive drum 103 side than the pressing portion 561 when the cover 558 is in the open state is.

As shown in parts (a) to (c) of FIG. 17, to the slidable portion 525, the slide assisting portion 539 is mounted on one end side. In the slide assisting portion 539, the accommodating space 562 which will be described later and in which the pressing portion 561 is accommodated is formed. Further, the slide assisting portion 539 includes a first portion-to-be-urged 566 (portion-to-be-urged), a second portion-to-be-urged 567 (curved portion) and a third portion-to-be-urged 569. As shown in part (a) of FIG. 17, in the case where the optical print head 105 in the retracted position, the first portion-to-be-urged 566 is positioned on the movement locus 564, and the second portion-to-be-urged 567 is provided adjacently to the first portion-to-be-urged 566 on a side (front side) downstream of the first portion-to-be-urged 566 with respect to a direction along the movement locus 564. The third portion-to-be-urged 569 is positioned on an upper side of the second portion-to-be-urged 567 and on the side (front side) downstream of the second portion-to-be-urged 567. The first portion-to-be-urged 566 and the second portion-to-be-urged 567 may be a continuous surface, and a surface different from these surfaces may also exist between the first portion-to-be-urged 566 and the second portion-to-be-urged 567. Further, the second portion-to-be-urged 567 and the third portion-to-be-urged 568 may also be a continuous surface, and a surface different from these surfaces may also exist between the first portion-to-be-urged 566 and the third portion-to-be-urged 568. As shown in part (c) of FIG. 17, a shape of the second portion-to-be-urged 567 is a shape which coincides with a part of a circle with the rotational axis 563 as a center in the case where the pressing portion 561 is on the second portion-to-be-urged 567. At this time, curvature of the circle in which the rotational axis 563 is the center and a distance from the rotational axis 563 to the second portion-to-be-urged 567 is a radius is substantially equal to curvature of the movement locus 564. In interrelation with movement of the cover 558 from the open state in which the closes state, from a state in which the pressing portion 561 opens the first portion-to-be-urged 566, the pressing portion 561 successively move on the first portion-to-be-urged 566, the second portion-to-be-urged 567 and a fourth portion-to-be-urged 568.

Action of the pressing portion 561 on the slidable portion 525 will be described using parts (a)-(d) of FIG. 17. When the cover 558 is in the state (open state) of part (a) of FIG. 17, the optical print head 105 is positioned at the retracted position, and the pressing portion 561 is positioned on the other end side of the first portion-to-be-urged 566 and the second portion-to-be-urged 567. When the cover 558 rotates clockwise from the state of part (a) of FIG. 17, the pressing portion 561 is positioned on the movement locus 564 and contacts a first portion-to-be-urged 566 (portion-to-be-urged) (part (b) of FIG. 17). When the cover 558 further rotates clockwise from this state, the pressing portion 561 presses the first portion-to-be-urged 566 toward the front side. By that, the slide assisting portion 539 moves toward the front side. The slide assisting portion 539 is fixed to the slidable portion 525, and therefore, the slidable portion 525 also slides (moves) toward the front side with movement of the slide assisting portion 539. Here, in order to increase a movement amount of the slidable portion 525 relative to a rotation amount of the cover 558 to the extent possible, ideally, the first portion-to-be-urged 566 may desirably be perpendicularly to the rotational axis of the photosensitive drum 103. However, strictly, the first portion-to-be-urged 566 is not necessarily be perpendicular to the rotational axis of the photosensitive drum 103, and for example, may also be inclined from the perpendicular direction toward the front side by about 0-10°.

Further, when the cover 558 rotates clockwise, the pressing portion 561 moves from on the first portion-to-be-urged 566 to on a second portion-to-be-urged 567 (part (c) of FIG. 17). The second portion-to-be-urged 567 forms a curved surface having a shape following the movement locus 564 of the pressing portion 561. For that reason, in the case where the cover 558 further rotates clockwise from the state of part (c) of FIG. 17, the pressing portion 561 moves toward the upper side while contacting the second portion-to-be-urged 567, but a force for sliding (moving) the slide assisting portion 539 toward further front side is not imparted from the pressing portion 561. That is, the slidable portion 525 maintains the rest state without moving in interrelation with the rotation of the cover 558. When the cover 558 is in the state (closed position) of part (c) of FIG. 17, the optical print head 105 is positioned at the exposure position and the pressing portion 561 is positioned on one end side of the first portion-to-be-urged 566 and closer to the rotational axis of the photosensitive drum 103 than the first portion-to-be-urged 566.

From part (c) of FIG. 16 and part (c) of FIG. 17, immediately after the holding member 505 is in the exposure position by rotating the cover 558 from the open state to the closed state, the pressing portion 561 contacts the second portion-to-be-urged 567 of the accommodating space 562. In the case where the cover 558 further rotates clockwise from the state of part (c) of FIG. 15, the pressing portion 561 moves while sliding in a state in which the pressing portion 561 contacted the second portion-to-be-urged 567. In a state in which the pressing portion 561 contacts the second portion-to-be-urged 567, a distance between the movement locus 564 and the second portion-to-be-urged 567 is the same irrespective of the position of the pressing portion 561. For that reason, even when the cover 558 rotates, the force for sliding (moving) the slide assisting portion 539 toward further front side is not imparted from the pressing portion 561 to the second portion-to-be-urged 567. Accordingly, during movement of the pressing portion 561 on the second portion-to-be-urged 567, the slide assisting portion 539 is prevented from moving from the rear side toward the front side. Further, by a self-weight of the holding member 505 or the like, the slidable portion 525 will slide (move) from the front side toward the rear side, but the pressing portion 561 abuts against the second portion-to-be-urged 567 from the rear side toward the front side, and therefore, the slidable portion 525 does not move from the front side toward the rear side. That is, the moving mechanism 640 of this embodiment is constituted so that when the cover 558 is rotated in the state in which the pressing portion 561 contacted the first portion-to-be-urged 566, the slidable portion 525 slides (moves) in interrelation with movement of the pressing portion 561, but so that even when the cover 558 is rotated in the state in which the pressing portion 561 contacted the second portion-to-be-urged 567, the slidable portion 525 does not slide (move). When the cover 558 further rotate clockwise from the state of part (c) of FIG. 17, the pressing portion 561 moves onto the third portion-to-be-urged 569, so that the cover 558 is in the closed state shown in part (d) of FIG. 17.

By employing the constitution as described above, a movement amount of the slidable portion 525 relative to a movement amount of the pressing portion 561 in the front-rear direction when the pressing portion 561 contacts (or urges) the second portion-to-be-urged 567 can be made smaller than a movement amount of the slidable portion 525 relative to a movement amount of the pressing portion 561 in the front-rear direction when the pressing portion 561 urges the first portion-to-be-urged 566. That is, a movement amount of the projection 655 in the up-down direction relative to the movement amount of the pressing portion 561 in the front-rear direction when the pressing portion 561 contacts (urges) the second portion-to-be-urged 567 can be made smaller than a movement amount of the projection 655 in the up-down direction relative to the movement amount of the pressing portion 561 in the front-rear direction when the pressing portion 561 urges the first portion-to-be-urged 566. In other words, a slide movement amount of the slidable portion 525 per a unit rotation amount of the cover 558 when the pressing portion 561 urges the second portion-to-be-urged 567 is smaller than a slide movement amount of the slidable portion 525 per a unit rotation amount of the cover 558 when the pressing portion 561 urges the first portion-to-be-urged 566. Further, rotation amounts of the link members 651-654 per the unit rotation amount of the cover 558 when the pressing portion 561 urges the second portion-to-be-urged 567 is smaller than rotation amounts of the link members 651-654 per the unit rotation amount of the cover 558 when the pressing portion 561 urges the first portion-to-be-urged 566.

Incidentally, there is no need that the second portion-to-be-urged 567 has a shape strictly along the movement locus 564. For example, the second portion-to-be-urged 567 may also have a shape (inclined surface inclined relative to the photosensitive drum 103 side from the front side toward the rear side) roughly along a tangential line with, as a contact point, a point on the movement locus 564 closest to a boundary portion between the first portion-to-be-urged 566 and the second portion-to-be-urged 567. In summary, the second portion-to-be-urged 567 may only be required to be a shape such that a state in which the slidable portion 525 and the link members 651-654 are at rest is maintained even in the case where after the optical print head 105 moves to the exposure position, the cover 558 is further rotated by an operator. Incidentally, the rest state referred to herein refers to a state in which the spring pressure applied to the contact pin 514 (515) when the optical print head 105 is positioned at the exposure position is maintained within a certain range. In this embodiment, an ideal value of the spring pressure is 350 g weight, but there is no need that the spring pressure is strictly 350 g weight. The spring pressure may also fluctuate if the spring pressure falls within a range of ± about 30% of the ideal value (within the certain range), i.e., within a range of 250-450 g weight. If the spring pressure is maintained in the above-described certain range, after the optical print head 105 moves to the exposure position, movement of the slidable portion 525 and the link members 651-654 is permitted.

Figure 18:
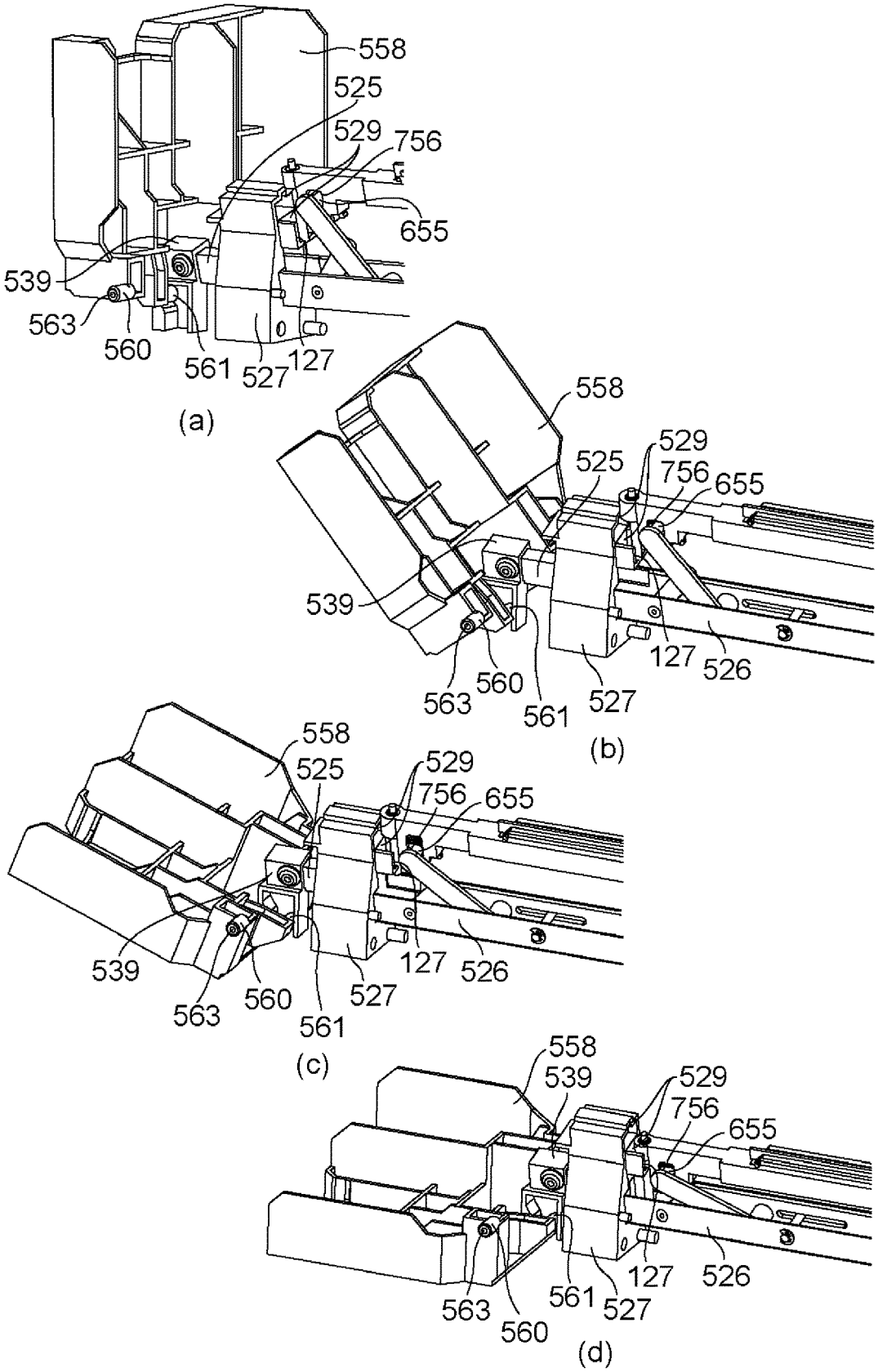
FIG. 18 includes perspective views of the cover for illustrating an operation when the cover is opened.
Figure 19:
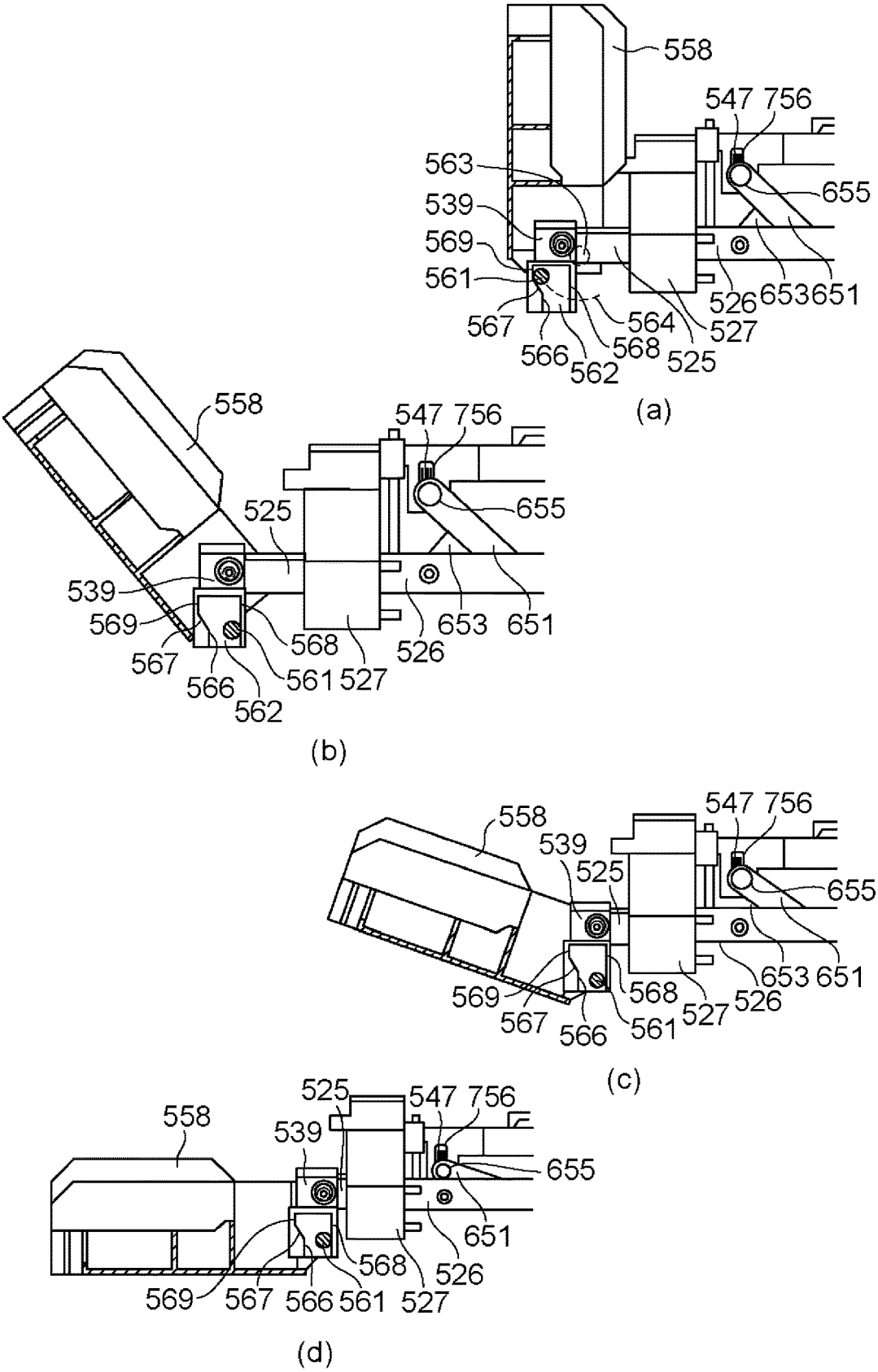
FIG. 19 includes perspective views of the cover for illustrating the operation when the cover is opened.

Parts (a)-(d) of FIG. 18 are perspective views showing the cover 558 rotating from the closed state toward the open state. Parts (a)-(d) of FIG. 19 are sectional views showing the cover 558 rotating from the open state toward the closed state. Part (a) of FIG. 18 and part (a) of FIG. 19 show the closed state of the cover 558. Part (d) of FIG. 18 and part (d) of FIG. 19 show the open state of the cover 558. Part (b) of FIG. 18 and part (b) of FIG. 19, and part (c) of FIG. 18 and part (c) of FIG. 19 are the views showing the cover 558 shifting from the closed state to the open state.

In the closed state of the cover 558 shown in part (a) of FIG. 19, by a self-weight of the optical print head 105 and a restoring force of a spring described later, a force for sliding (moving) the slidable portion 525 from the front side toward the rear side via the first link mechanism 861 and the second link mechanism 862 acts on the slidable portion 525. However, the cover 558 in the closed state is fixed to the image forming apparatus 1 main assembly so as not to rotate, and the pressing portion 561 restricts movement of the slide assisting portion 539 toward the rear side, and therefore, the slidable portion 525 does not slide (move) toward the rear side.

As shown in FIG. 19, the slide assisting portion 539 includes the fourth portion-to-be-urged 568. The fourth portion-to-be-urged 568 is on the above-described movement locus 564 and is provided on the rear side than the pressing portion 561 is, and opposes the first portion-to-be-urged 566. Here, in this embodiment, the fourth portion-to-be-urged 568 is perpendicular to the rotational axis of the photosensitive drum 103, but there is no need that the fourth portion-to-be-urged 568 is strictly perpendicular to the rotational axis of the photosensitive drum 103, and for example, the fourth portion-to-be-urged 568 may also be inclined from the perpendicular direction toward the front side or the rear side by about 0-10°.

When the cover 558 rotates counterclockwise from (a state of) part (a) of FIG. 19, the pressing portion 561 contacts a fourth portion-to-be-urged 568 as shown in part (b) of FIG. 19. When the cover 558 further rotate counterclockwise from a state of part (b) of FIG. 19, the pressing portion 561 presses the third portion-to-be-urged 568 from the front side toward the rear side as shown in parts (b) of FIG. 19 and (c) of FIG. 19, and therefore, the slidable portion 525 moves toward the rear side. Thereafter, when the cover 558 further rotate counterclockwise, the cover 558 is in the open state as shown in part (d) of FIG. 19.

A mechanism in which the pressing portion 561 presses the fourth portion-to-be-urged 568 is provided for the following reason. Even if movement restriction to the slide assisting portion 539 by the pressing portion 561 is released by rotating the cover 558 counterclockwise from the state of part (a) of FIG. 18, when a frictional force between the respective link members, a frictional force between the link member 651 or the link member 653 and the slidable portion 525 and a frictional force between the link member 652 or the link member 654 and the third supporting portion 526 are large, the case where the slidable portion 525 does not slides (moves) toward the rear side would be considered. That is, the case where even when the cover 558 is opened, the slidable portion 525 does not slides (moves) would be considered. On the other hand, in order to move the slidable portion 525 toward the rear side by opening the cover 558, the moving mechanism 640 of this embodiment includes a mechanism in which the pressing portion 561 presses the fourth portion-to-be-urged 568.

By the above-described constitution, the operator for performing maintenance opens and closes the cover 558, so that the slidable portion 525 slides (moves) relative to the third supporting portion 526 in interrelation with movement of the cover 558.

Incidentally, as a member for sliding (moving) the slidable portion 525, the member is not limited to the cover 558, but a lever may also be used. Further, in this case, the lever is formed in a structure integral with the cover rotatably mounted to the image forming apparatus 1 main assembly, and may also be moved in interrelation with opening and closing of the cover by an operation for performing maintenance.

The first portion-to-be-urged 566, the second portion-to-be-urged 567 and the fourth portion-to-be-urged 568 in this embodiment are surfaces to which the pressing portion 561 is contacted, but structures thereof are not limited to planar shapes but may also be linear shapes.

Figure 20:
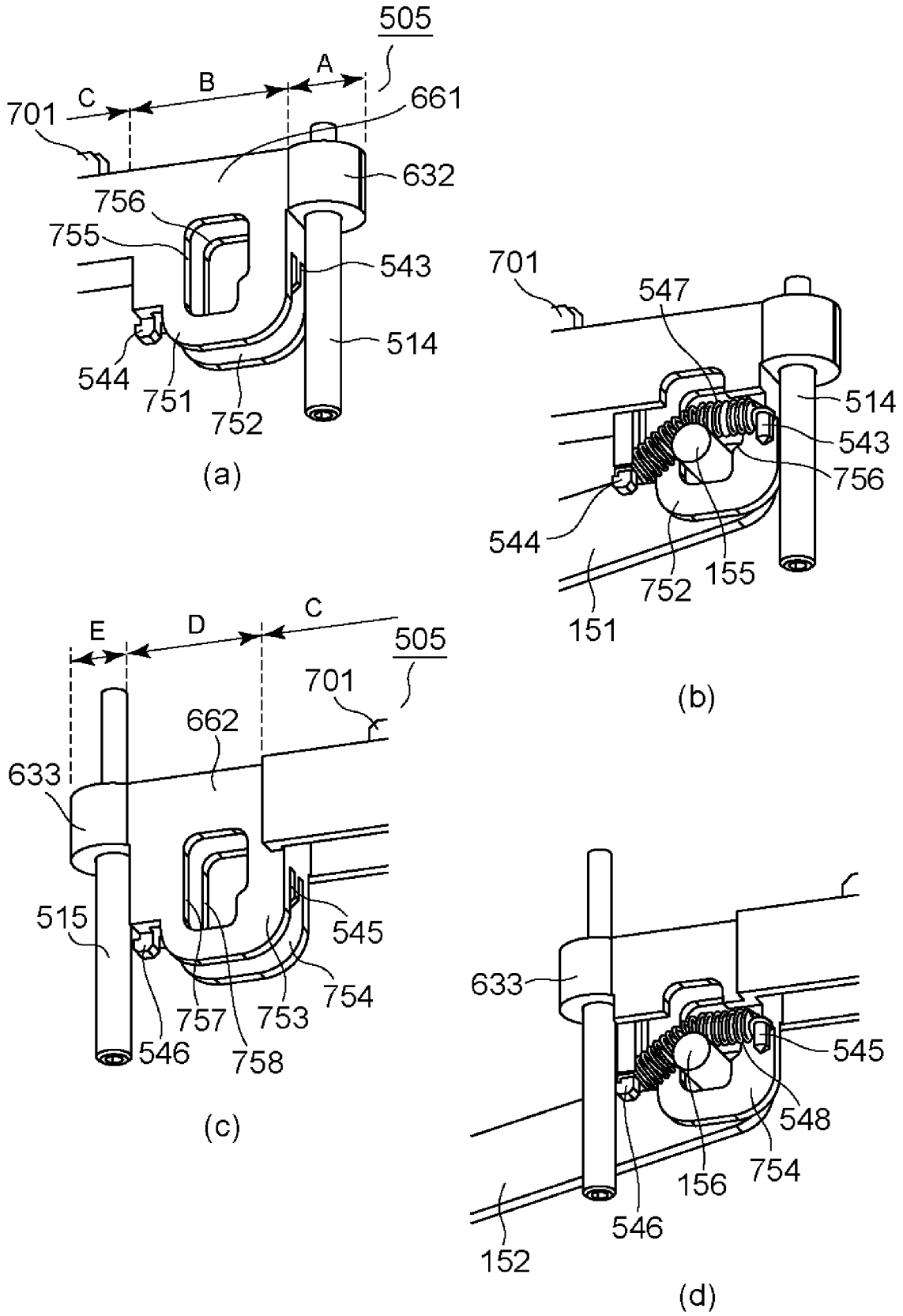
FIG. 20 includes perspective views for illustrating a structure of a holding member on both ends.

Next, a connecting mechanism between the holding member 505 and the link member 151 will be described. Incidentally, a connecting mechanism, described in the following, between the holding member 505 and the link member 151 is the substantially same mechanism as a connecting mechanism between the holding member 505 and the link member 651. Parts (a) and (c) of FIG. 20 are perspective views showing one end side of the holding member 505 with respect to the front-rear direction. Parts (b) and (d) of FIG. 20 are perspective views showing the other end side of the holding member 505 with respect to the front-rear direction.

As shown in part (a) of FIG. 18, the holding member 505 includes the lens mounting portion 701 on which the lens array 506 is mounted, the spring mounting portion 661 in which the coil spring 547 is mounted, the spring mounting portion 662 in which the coil spring 548 is mounted, the pin mounting portion 632 in which the contact pin 514 is mounted, and the pin mounting portion 633 in which the contact pin 515 is mounted. The holding member 505 is a molded product which is obtained by integrally injection-molding the lens mounting portion 701, the substrate mounting portion 702 (not shown), the spring mounting portion 661 and the spring mounting portion 662 and which is made of a resin (material). With respect to the front-rear direction, the spring mounting portion 661 is disposed on one end side of the lens mounting portion 701, and the pin mounting portion 632 is disposed on a further end portion side of the holding member 505 than the spring mounting portion 661 is. Further, with respect to the front-rear direction, the spring mounting portion 662 is disposed on the other end side of the lens mounting portion 701, and the pin mounting portion 632 is disposed on a further end portion side than the spring mounting portion 662 is. In the holding member 505, when portions where the lens mounting portion 701, the spring mounting portion 661 and the pin mounting portion 632 are formed are shown in the figure, in part (a) of FIG. 20, the portions are portions shown by a region of C, a region of B and a region of A. To the holding member 505, on a side in front of the lens array 506 and in rear of the contact pin 514, an urging force is imparted from a lower side toward an upper side by the projection 155 of the link member 151 via the coil spring 547. Further, using part (c) of FIG. 20, when portions where the lens mounting portion 701, the spring mounting portion 662 and the pin mounting portion 633 are formed are shown in the figure, the portions are portions shown by the region of C, a region of D and a region of E, respectively. To the holding member 505, on a side in rear of the lens array 506 and in front of the contact pin 515, an urging force is imparted from a lower side toward an upper side by the projection 156 of the link member 152 via the coil spring 548.

First, the spring mounting portion 661 will be described. The spring mounting portion 661 includes a first wall portion 751, a second wall portion 752, a first engaging portion 543 and a second engaging portion 544. The first wall portion 751 is disposed on one end side of the holding member 505 with respect to the left-right direction, and the second wall portion 752 is disposed on the other end side of the holding member 505 with respect to the left-right direction. In this embodiment, with respect to the left-right direction, the first wall portion 751 and the second wall portion 752 are disposed on both sides of the contact pin 514. As shown in part (a) of FIG. 20, the first wall portion 751 and the second wall portion 752 include inner wall surfaces opposing each other. In the first wall portion 751, an opening 755 is formed, and in the second wall portion 752, an opening 756 is formed. The opening 755 and the opening 756 are elongated holes extending in the up-down direction. In the opening 755 and the opening 756, the projection 155 is inserted. The projection 155 is not engaged with the opening 755 and the opening 756, and is inserted with a gap of about 0.5 mm at a narrowest portion with respect to the front-rear direction. For this reason, a movement direction of the projection 155 is guided with respect to the up-down direction by the opening 755 and the opening 756 without receiving a large frictional force from the inner wall surfaces of the opening 755 and the opening 756.

Part (b) of FIG. 20 is a drawing in which the first wall portion 751 is removed from part (a) of FIG. 20. With respect to the left-right direction, between the first wall portion 751 and the second wall portion 752, the first engaging portion 543 and the second engaging portion 544 are disposed. Further, the first engaging portion 543 and the second engaging portion 544 are disposed between the opening 755 and the opening 756. In this embodiment, the first engaging portion 543 is disposed on an end portion side of the holding member 505 than the second engaging portion 544 is. The first engaging portion 543 and the second engaging portion 544 are projections projecting downwardly from connecting portions connecting the first wall portion 751 and the second wall portion 752 of the holding member 505. With the first engaging portion 543, one end of the coil spring 547 is engaged, and with the second engaging portion 544, the other end of the coil spring 547 is engaged. The first engaging portion 543 and the second engaging portion 544 are disposed on the spring mounting portion 661 so that the coil spring 547 engaged with the first engaging portion 543 and the second engaging portion 544 crosses the opening 755 and the opening 756.

With respect to the up-down direction, the first engaging portion 543 and the second engaging portion 544 are disposed at different positions. In this embodiment, the first engaging portion 543 is disposed on the photosensitive drum 103 side than the second engaging portion 544 is. Incidentally, the first engaging portion 543 and the second engaging portion 544 may be provided at the same level with respect to the up-down direction, and the second engaging portion 544 may be disposed on the photosensitive drum 103 side than the first engaging portion 543 is.

As shown in part (b) of FIG. 20, the projection 155 is inserted from an outer wall surface side of the second wall portion 752 into the opening 756 and passes under the coil spring 547 bridged between the first engaging portion 543 and the second engaging portion 544, and is inserted into the opening 755 of the first wall portion 751.

Next, the spring mounting portion 662 will be described. As shown in part (c) of FIG. 20, the spring mounting portion 662 includes a third wall portion 753, a fourth wall portion 754, a third engaging portion 545 and a fourth engaging portion 546. The third wall portion 753 is disposed on one end side of the holding member 505 with respect to the left-right direction, and the fourth wall portion 754 is disposed on the other end side of the holding member 505 with respect to the left-right direction. In this embodiment, with respect to the left-right direction, the third wall portion 753 and the fourth wall portion 754 are disposed on both sides of the contact pin 515. The first wall portion 751 and the third wall portion 753 are disposed on the same side with respect to the left-right direction, i.e., the first wall portion 751 and the third wall portion 753 are disposed on the right side of the holding member 505. The second wall portion 752 and the fourth wall portion 754 are disposed on the same side with respect to the left-right direction, i.e., the second wall portion 752 and the fourth wall portion 754 are disposed on the left side of the holding member 505.

As shown in part (c) of FIG. 20, the third wall portion 753 and the fourth wall portion 754 include inner wall surfaces opposing each other. In the third wall portion 753, an opening 757 is formed, and in the fourth wall portion 754, an opening 758 is formed. The opening 757 and the opening 758 are elongated holes extending in the up-down direction. In the opening 757 and the opening 758, the projection 156 is inserted. The projection 156 is not engaged with the opening 757 and the opening 758, and is inserted with a gap of about 0.5 mm at a narrowest portion with respect to the front-rear direction. For this reason, a movement direction of the projection 156 is guided with respect to the up-down direction by the opening 757 and the opening 758 without receiving a large frictional force from the inner wall surfaces of the opening 757 and the opening 758.

Part (d) of FIG. 20 is a drawing in which the third wall portion 753 is removed from part (c) of FIG. 20. The third engaging portion 545 and the fourth engaging portion 546 are disposed between the third wall portion 753 and the fourth wall portion 754 with respect to the left-right direction. Further, this third engaging portion 545 and this fourth engaging portion 546 are disposed between the opening 757 and the opening 758. In this embodiment, the fourth engaging portion 546 is disposed further toward an end portion side of the holding member 505 than the third engaging portion 545. The third engaging portion 545 and the fourth engaging portion 546 are projections projecting downwardly from connecting portions connecting the third wall portion 753 and the fourth wall portion 754 of the holding member 505. With the third engaging portion 545, one end of the coil spring 548 is engaged, and with the fourth engaging portion 546, the other end of the coil spring 548 is engaged. The third engaging portion 545 and the fourth engaging portion 546 are disposed on the spring mounting portion 662 so that the coil spring 548, when engaged with the third engaging portion 545 and the fourth engaging portion 546, crosses the opening 757 and the opening 758.

With respect to the up-down direction, the third engaging portion 545 and the fourth engaging portion 546 are disposed at different positions. In this embodiment, the third engaging portion 545 is disposed on the photosensitive drum 103 side than the fourth engaging portion 546 is. Incidentally, the third engaging portion 545 and the fourth engaging portion 546 may be provided at the same level with respect to the up-down direction, and the fourth engaging portion 546 may be disposed on the photosensitive drum 103 side than the third engaging portion 545 is.

As shown in part (d) of FIG. 20, the projection 156 is inserted from an outer wall surface side of the fourth wall portion 754 into the opening 758 and passes under the coil spring 548 bridged between the third engaging portion 545 and the fourth engaging portion 546, and is inserted into the opening 757 of the third wall portion 753. Incidentally, in this embodiment, as an example of the coil spring 547 and the coil spring 548, a coil-shaped spring is shown, but a leaf spring may also be used.

Next, action of the projection 155 provided on the link member 151 on the coil spring 547, and action of the projection 156 provided on the link member 152 on the coil spring 548 will be described using FIG. 21. The action of the projection 156 on the coil spring 548 and the action of the projection 156 on the coil spring 548 are substantially similar to each other, so that in FIG. 21, the action of the projection 655 on the coil spring 547 will be illustrated by example.

Figure 21:
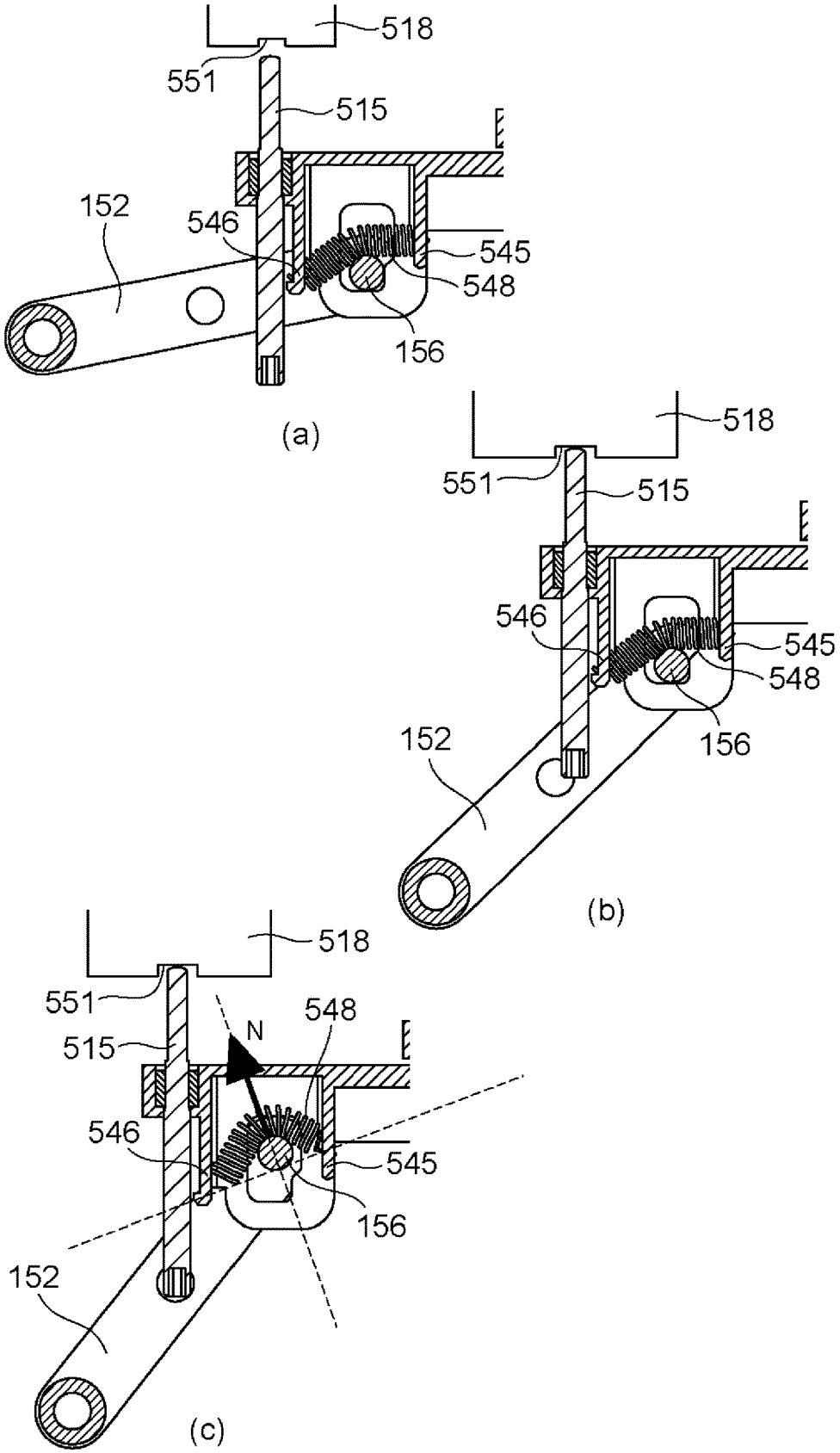
FIG. 21 includes perspective views for illustrating the structure of the holding member on the other end.

Part (a) of FIG. 21 is a view showing a state in which the contact pin 515 provided in the holding member 505 is retracted from the contact surface 551 of the drum unit 518. Part (b) of FIG. 21 is a view showing a time when the contact pin 515 contacted the contact surface 551 of the drum unit 518. Part (c) of FIG. 21 is a view showing a state in which the link member 152 is rotated counterclockwise from the state of part (b) of FIG. 21.

In the state of part (a) of FIG. 21, when the slidable portion 525 slides (moves), the link member 152 rotates counterclockwise in interrelation therewith, so that the projection 156 moves to the upper side. At this time, the projection 156 presses the coil spring 548 toward the upper side. When the projection 156 presses the coil spring 548 toward the upper side, a force acts on the holding member 505 on the upper side via the third engaging portion 545 and the fourth engaging portion 546. The contact pin 515 is non-contact with the drum unit 518. There is no force against a force, by which the projection 156 presses the coil spring 548, except for gravitation acting on the optical print head 105. For that reason, when the force acting on the third engaging portion 545 and the fourth engaging portion 546 toward the upper side becomes larger than the gravitation acting on the optical print head 105, the holding member 505 moves toward the upper side by the force acting on the third engaging portion 545 and the fourth engaging portion 546. Here, when the holding member 505 is in the retracted position, a lower end of the contact pin 515 (514) and the holding member 505 are supported by the apparatus main assembly, so that the projection 156 (155) of the link member 152 (151) may also be made in non-contact with the coil spring 548 (547).

When the holding member 505 moves to the upper side, as shown in part (b) of FIG. 21, the contact pin 515 contacts the contact surface 551 of the drum unit 518. In part (b) of FIG. 21, the optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 140 of this embodiment has a constitution in which the link member 152 is further rotatable from the state of part (b) of FIG. 21.

Even when the link member 152 further rotates counterclockwise from the state of part (b) of FIG. 21, the contact pin 515 contacts the contact surface 551 of the drum unit 518, and therefore, the position of the holding member 505 does not change. On the other hand, the projection 656 moves in the upper side direction. For that reason, the coil spring 548 is pressed between the third engaging portion 545 and the fourth engaging portion 546 by the projection 156 and is extended by being bent as shown in part (c) of FIG. 21.

The state of part (c) of FIG. 21 corresponds to states of the cover 558 in parts (c) and (d) of FIG. 17. That is, the slidable portion 525 is in a state in which the slidable portion 525 does not further slide (move) toward the upper side. For that reason, the slidable portion 525 does not slide (move), and therefore, the link member 152 does not rotate counterclockwise from the state shown in part (c) of FIG. 21, and the projection 156 is at rest in the position of part (c) of FIG. 21 without moving toward the upper side. In this state, a contracting force of the coil spring 548 acts on the third engaging portion 545 and the fourth engaging portion 546. A component of the contracting force of the coil spring 548 acting on the third engaging portion 545 and the fourth engaging portion 546 is pointed in an upper direction, and therefore, an urging force for urging the holding member 505 toward the drum unit 518 side acts on the holding member 505 so that the holding member 505 is urged toward the drum unit 518 via the contact pin 515.

As described above, the third engaging portion 545 is disposed on the photosensitive drum 103 side than the fourth engaging portion 546 is, and therefore, drag (reaction) in an arrow N direction acts on the coil spring 548 from the projection 156. A component of the drag in the arrow N direction acts on the holding member 505. For that reason, on the contact pin 515, a force toward the rear side with respect to the front-rear direction acts, so that the contact pin 515 contacted to the contact surface 551 is urged against and contacted to the rear side wall surface 596 on the rear side of the engaging portion 685. The reason why the first engaging portion 543 is disposed on the photosensitive drum 103 side than the second engaging portion 544 is also similar to the above-described reason.

Modified Embodiment 1

As a modified embodiment 1, as to the coil spring 547 and the coil spring 548 mounting portion 661 and the spring mounting portion 662, an example of a mounting method thereof will be described using part (a) of FIG. 22 and part (b) of FIG. 22. Members having the substantially same functions as those of the moving mechanism 140 are described by adding thereto the same symbols and will be omitted from redundant description in some cases.

Figure 22:
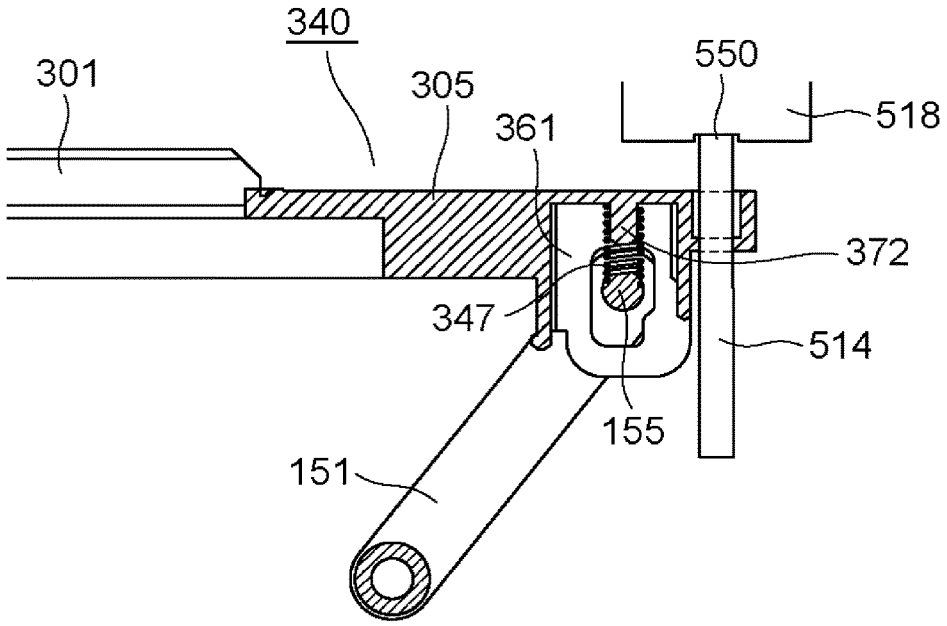
FIG. 22 includes views for illustrating a structure of one end of a holding member in a modified embodiment 1.
Figure 22:
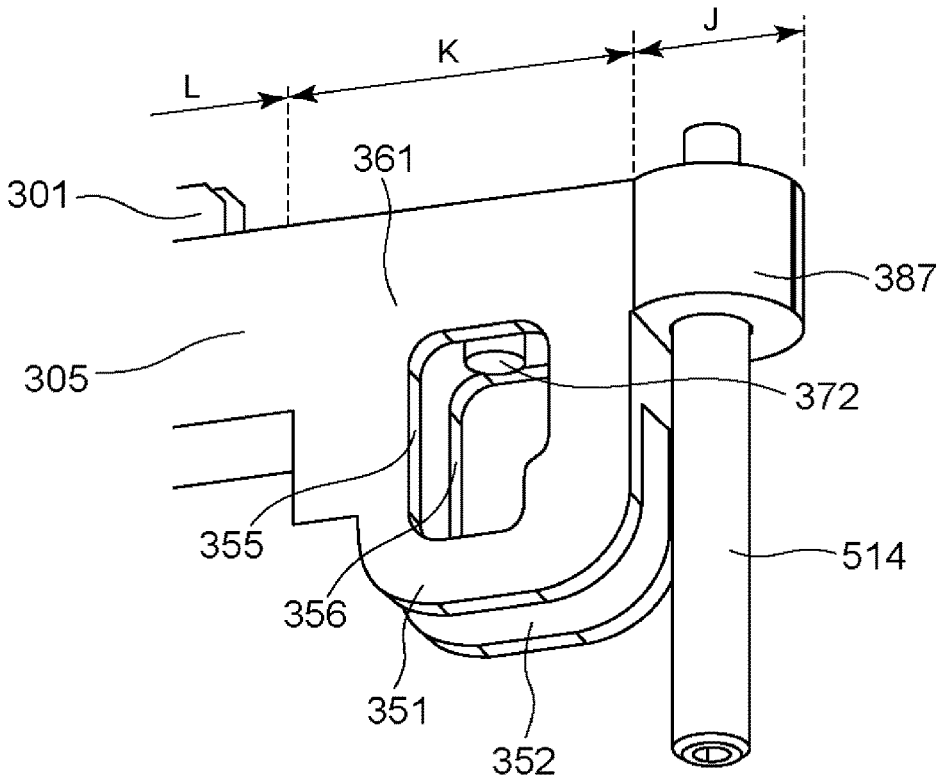

The holding member 505 shown in part (a) of FIG. 22 and part (b) of FIG. 22 includes the lens mounting portion 301 on which the lens array 506 is mounted, the spring mounting portion 361 in which the coil spring 347 is mounted, the spring mounting portion 362 in which the coil spring 348 is mounted, the pin mounting portion 387 in which the contact pin 514 is mounted, and the pin mounting portion 388 in which the contact pin 515 is mounted. Incidentally, in parts (a) and (b) of FIG. 22, only the front side of the holding member 305 is shown, and therefore, the spring mounting portion 362 in which the coil spring 348 is mounted and the pin mounting portion 388 in which the contact pin 515 is mounted are not shown in the figure. The holding member 505 is a molded product which is obtained by integrally injection-molding the lens mounting portion 301, the substrate mounting portion 702 (not shown), the spring mounting portion 361, the spring mounting portion 362, the pin mounting portion 387 and the pin mounting portion 388. With respect to the front-rear direction, the spring mounting portion 361 is disposed on one end side of the holding member 305 than the lens mounting portion 301 is, and the pin mounting portion 387 is disposed on a further end portion side of the holding member 305 than the spring mount portion 361 is. Further, with respect to the front-rear direction, the spring mounting portion 362 is disposed on the other end side of the holding member 305 than the lens mounting portion 301 is, and the pin mounting portion 388 is disposed on a further end portion side than the spring mounting portion 362 is.

Using part (b) of FIG. 22, the spring mounting portion 361 will be described. The spring mounting portion 361 includes a first wall portion 351, a second wall portion 352, and an engaging portion 372. Further, using part (b) of FIG. 22, when portions where the lens mounting portion 301, the spring mounting portion 361 and the pin mounting portion 387 are formed are shown in the figure, the portions are portions shown by the region of L, a region of K and a region of J, respectively. From parts (a) and (b) of FIG. 22, to the holding member 305, on a side in front of the lens array 506 and in rear of the contact pin 514, an urging force is imparted from a lower side toward an upper side by the projection 155 of the link member 151 via the coil spring 347. The first wall portion 351 is disposed on one end side of the holding member 305 with respect to the left-right direction, and the second wall portion 352 is disposed on the other end side of the holding member 305 with respect to the left-right direction. In the modified embodiment 1, with respect to the left-right direction, the first wall portion 351 and the second wall portion 352 are disposed on both sides of the contact pin 514. In the first wall portion 351, an opening 355 is formed, and in the second wall portion 352, an opening 356 is formed. The opening 355 and the opening 356 are elongated holes extending in the up-down direction. In the opening 355 and the opening 356, the projection 155 is inserted from the left side of the holding member 305 in the order of the opening 355 and the opening 356. The projection 155 is not engaged with the opening 355 and the opening 356, and is inserted with a gap of about 0.5 mm at a narrowest portion with respect to the front-rear direction. For that reason, a movement direction of the projection 155 is guided with respect to the up-down direction by the opening 355 and the opening 356 without receiving a large frictional force from the inner wall surfaces of the opening 355 and the opening 356. As shown in part (b) of FIG. 22, the engaging portion 372 is a cylinder-shaped projection standing from the upper side toward the lower side between the first wall portion 351 and the second wall portion 352. Further, as shown in part (a) of FIG. 22, around the engaging portion 372, one end of the coil spring 347 is inserted from the lower side toward the upper side. Further, the other end side of the coil spring 347 contacts the projection 155. That is, a contact between the other end side of the coil spring 347 and the projection 155 is positioned on the side lower than a contact portion between one end side of the coil spring 347 and the engaging portion.

Further, part (a) of FIG. 22 is a state immediately after the optical print head 105 moves from the retracted position toward the exposure position and the contact pin 514 contacts the contact surface 550. The optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 340 of this modified embodiment has a constitution in which the link member 151 is further rotatable from the state of part (b) of FIG. 22.

Even when the link member 151 further rotates counterclockwise from the state of part (b) of FIG. 22, the contact pin 514 contacts the contact surface 550 of the drum unit 518, and therefore, the position of the holding member 305 does not change. On the other hand, the projection 155 moves in the upper side direction, and therefore, the coil spring 547 is nipped and compressed between the engaging portion 372 and the projection 155. A state in which the link member 381 rotates counterclockwise from the above-described state of part (c) of FIG. 22 corresponds to states of the cover 558 in parts (c) and (d) of FIG. 16 and parts (c) and (d) of FIG. 17. That is, the slidable portion 525 is in a state in which the slidable portion 525 does not further slide (move) toward the upper side. The slidable portion 525 does not slide (move), and therefore, the link member 151 does not rotate counterclockwise further, and also the projection 155 is at rest without moving toward the upper side. In this state, by a restoring force of the compressed coil spring 347, an urging force for urging the holding member 305 toward the drum unit 518 side acts on the holding member 305, so that the holding member 305 is urged toward the drum unit 518 via the contact pin 515. Further, when the holding member 305 is in the retracted position, the lower end of the contact pin 514 (515) and the holding member 305 are supported by the apparatus main assembly, the projection 155 (156) of the link member 151 (152) may also be in non-contact with the coil spring 347 (348).

Modified Embodiment 2

Next, regarding a mounting method of a coil spring 477 and a coil spring 458 mounted to a holding member 405, another modified example will be described using part (a) of FIG. 23 and part (b) of FIG. 23.

Figure 23:
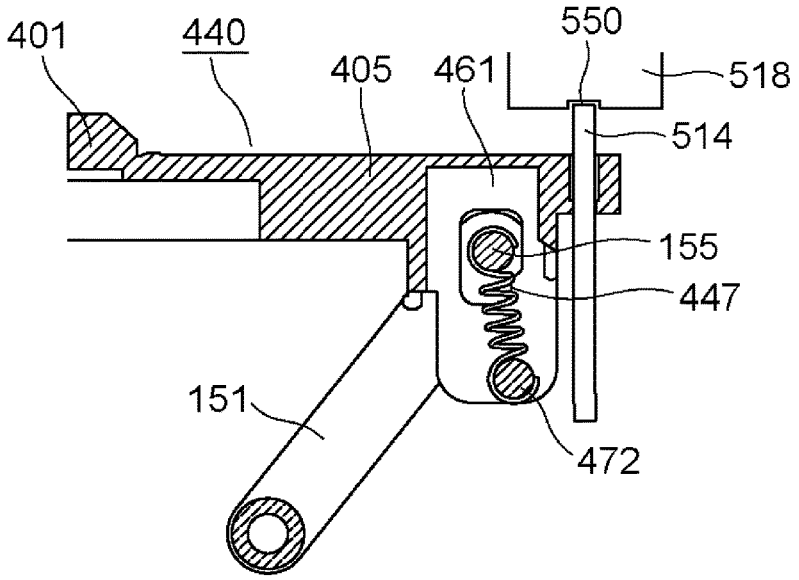
FIG. 23 includes views for illustrating a structure of one end of a holding member in a modified embodiment 2.
Figure 23:
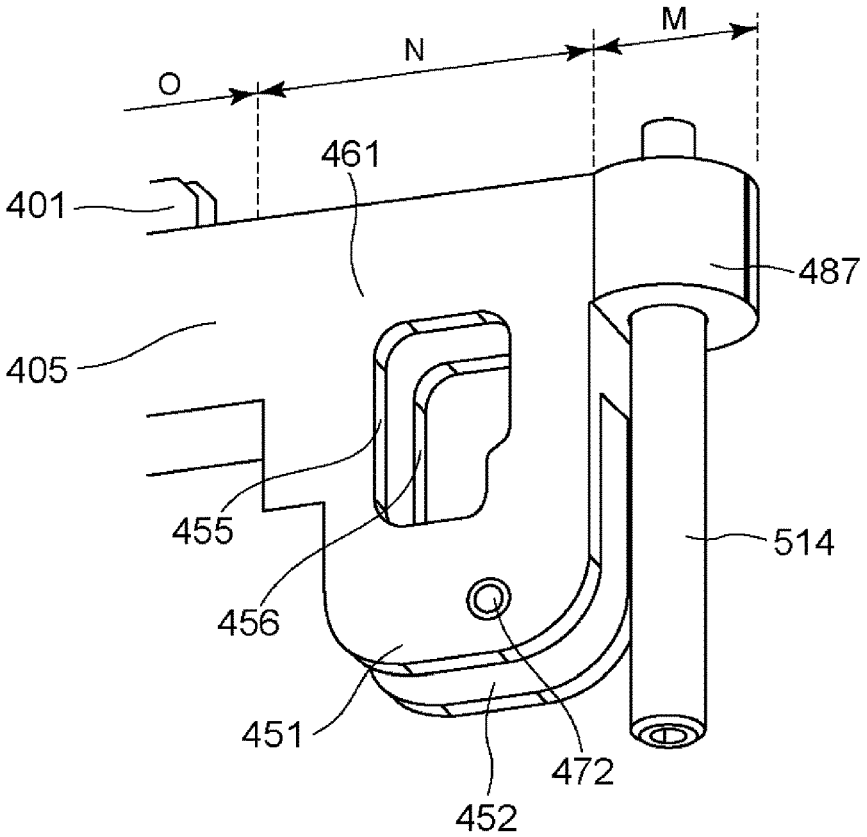

The holding member 405 shown in part (a) of FIG. 23 and part (b) of FIG. 23 includes the lens mounting portion 301 on which the lens array 506 is mounted, the spring mounting portion 461 in which the coil spring 447 is mounted, the spring mounting portion 462 in which the coil spring 448 is mounted, the pin mounting portion 487 in which the contact pin 514 is mounted, and the pin mounting portion 488 in which the contact pin 515 is mounted. Incidentally, in part (b) of FIG. 23, only the front side of the holding member 405 is shown, and therefore, the spring mounting portion 462 in which the coil spring 448 is mounted and the pin mounting portion 488 in which the contact pin 515 is mounted are not shown in the figure. The holding member 405 is a molded product which is obtained by integrally injection-molding the lens mounting portion 401, the substrate mounting portion 702 (not shown), the spring mounting portion 461, the spring mounting portion 462, the pin mounting portion 487 and the pin mounting portion 488. With respect to the front-rear direction, the spring mounting portion 461 is disposed on one end side of the holding member 405 than the lens mounting portion 401 is, and the pin mounting portion 487 is disposed on a further end portion side of the holding member 405 than the spring mount portion 461 is. Further, with respect to the front-rear direction, the spring mounting portion 462 is disposed on the other end side of the holding member 405 than the lens mounting portion 401 is, and the pin mounting portion 488 is disposed on a further end portion side than the spring mounting portion 462 is.

Using part (b) of FIG. 23, the spring mounting portion 461 will be described. The spring mounting portion 461 includes a first wall portion 451, a second wall portion 452, and an engaging portion 472. Further, using part (b) of FIG. 23, when portions where the lens mounting portion 401, the spring mounting portion 461 and the pin mounting portion 487 are formed are shown in the figure, the portions are portions shown by the region of O, a region of N and a region of M, respectively. From parts (a) and (b) of FIG. 23, to the holding member 405, on a side in front of the lens array 506 and in rear of the contact pin 514, an urging force is imparted from a lower side toward an upper side by the projection 155 of the link member 151 via the coil spring 347. The first wall portion 451 is disposed on one end side of the holding member 405 with respect to the left-right direction, and the second wall portion 452 is disposed on the other end side of the holding member 405 with respect to the left-right direction. In this modified embodiment, with respect to the left-right direction, the first wall portion 451 and the second wall portion 452 are disposed on both sides of the contact pin 514. In the first wall portion 451, an opening 455 is formed, and in the second wall portion 452, an opening 456 is formed. The opening 455 and the opening 456 are elongated holes extending in the up-down direction. In the opening 455 and the opening 456, the projection 155 is inserted from the left side of the holding member 405 in the order of the opening 455 and the opening 456. As shown in part (a) of FIG. 23, the projection 155 is not engaged with the opening 755 and the opening 456, and is inserted with a gap of about 0.5 mm at a narrowest portion with respect to the front-rear direction. For that reason, a movement direction of the projection 155 is guided with respect to the up-down direction by the opening 455 and the opening 456 without receiving a large frictional force from the inner wall surfaces of the opening 455 and the opening 456. As shown in part (b) of FIG. 23, the engaging portion 372 is inserted from a hole provided in the first wall portion 451 toward the second wall portion 452 on the lower side of the opening 455 of the first wall portion 451 and the opening 456 of the second wall portion 452, and is fixed to the first wall portion 451. As shown in part (a) of FIG. 23, between the first wall portion 451 and the second wall portion 452, the other end of the coil spring 447 is hung on the engaging portion 472. Further, one end side of the coil spring 447 is rotatably connected to the projection 155. That is, a contact between the other end side of the coil spring 447 and the projection 155 is positioned on the side upper than a contact portion between one end side of the coil spring 447 and the engaging portion 472.

Further, part (a) of FIG. 23 is a state immediately after the optical print head 105 moves from the retracted position toward the exposure position and the contact pin 514 contacts the contact surface 550. The optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 440 of this modified embodiment has a constitution in which the link member 151 is further rotatable from the state of part (b) of FIG. 23.

Even when the link member 151 further rotates counterclockwise from the state of part (b) of FIG. 23, the contact pin 514 contacts the contact surface 550 of the drum unit 518, and therefore, the position of the holding member 405 does not change. On the other hand, the projection 155 moves in the upper side direction, and therefore, the coil spring 447 is expanded by between the engaging portion 472 and the projection 155.

A state in which the link member 151 rotates counterclockwise from the above-described state of part (c) of FIG. 23 corresponds to states of the cover 558 in parts (c) and (d) of FIG. 16 and parts (c) and (d) of FIG. 17. That is, the slidable portion 525 is in a state in which the slidable portion 525 does not further slide (move) toward the upper side. The slidable portion 525 does not slide (move), and therefore, the link member 151 does not rotate counterclockwise further, and also the projection 155 is at rest without moving toward the upper side. In this state, by a restoring force of the expanded coil spring 447, an urging force for urging the holding member 405 toward the drum unit 518 side acts on the holding member 405, so that the holding member 405 is urged toward the drum unit 518 via the contact pin 154.

Here, the coil spring 447 may also have a structure in which the coil spring 447 is directly expanded by the upper end portion of the link member 151, not the projection 155.

As described above, in the image forming apparatus 1 according to the above-described embodiments and modified embodiments, by the rotation of the cover 558 from the open state (open position) to the closed state (close position), the pressing portion 561 urges the first portion-to-be-urged 566, so that the slidable portion 525 moves from the rear side toward the front side. By this, the optical print head 105 moves from the retracted position toward the exposure position. Thereafter, by further rotation of the cover 558, the pressing portion 561 moves from the first portion-to-be-urged 566 onto the second portion-to-be-urged 567 and moves along the shape of the second portion-to-be-urged 567, so that the slidable portion 525 and the projection 655 (656) are maintained in the rest state without moving in interrelation with the rotation of the cover 558.

INDUSTRIAL APPLICABILITY

According to the present invention, there is provided the image forming apparatus including the optical print head which reciprocates between the exposure position where the photosensitive drum is exposed to light and the retracted position retracted from the photosensitive drum than the exposure position is, in order to exchange the exchange unit including the photosensitive drum.

EXPLANATION OF SYMBOLS

525 slidable portion
539 slide assisting portion
547 coil spring
558 cover
561 pressing portion (urging portion)
562 accommodating space
563 rotational axis
564 movement locus
566 first portion-to-be-urged
567 second portion-to-be-urged (curved portion)
569 third portion-to-be-urged
655 projection
756 opening

The invention claimed is:

1. An image forming apparatus comprising:

a drum unit which rotatably supports a photosensitive drum and which is mountable in and dismountable from an apparatus main assembly by inserting and extracting said drum unit from a side surface of said apparatus main assembly on a front side;

an optical print head for exposing said photosensitive drum to light;

a rotatable member which rotates about a rotational axis, as a rotation center, passing through a lower side of a rotational axis of said photosensitive drum with respect to a vertical direction and extending in a direction perpendicular to both of a longitudinal direction of said optical print head and the vertical direction, the rotatable member being movable between a closed position where a movement path of said drum unit when said drum unit is inserted in and extracted from said apparatus main assembly is closed and an open position where the movement path opens;

an urging portion provided on said rotatable member at a lower side of said rotational axis with respect to the vertical direction and moving together with said rotating rotatable member around said rotational axis; and a moving mechanism for moving said optical print head from a retracted position where said optical print head is retracted from said drum unit to permit insertion and extraction of said drum unit toward an exposure position where said drum unit is urged for exposing said photosensitive drum to light, said moving mechanism including:

(i) a slidable portion which includes a portion-to-be-urged positioned on a movement locus of said urging portion moving around the rotational axis of said rotatable member with rotation of said rotatable member from the open position to the closed position and urged by said moving urging member, and a curved portion provided adjacently to said portion-to-be-urged on a side downstream of said portion-to-be-urged with respect to the movement direction on the movement locus and forming a shape along the movement locus, and said slidable portion sliding in one direction with respect to the longitudinal direction relative to said apparatus main assembly;

(ii) a spring provided in said optical print head and imparting, to said optical print head, an urging force for urging said optical print head toward said drum unit; and (iii) a link portion rotatably connected to said optical print head on one end side and rotatably connected to said slidable portion on the other end side, wherein said link portion rotates with the slide of said slidable portion and deforms said spring in interrelation with the rotation, wherein said urging portion urges said portion-to-be urged with the rotation of said rotatable member, and said link member moves said optical print head from the retracted position to the exposure position, and thereafter said urging portion is moved from said portion-to-be-urged onto said curved portion and is moved along the shape of said curved portion by further rotation of said rotatable member, whereby said slidable portion and said link portion are kept in a rest state without being moved with the rotation of said rotatable member.

2. An image forming apparatus according to claim 1, wherein, in a case that said optical print head is positioned at the retracted position, said urging portion is positioned further toward a rear side of said apparatus main assembly with respect to the longitudinal direction than said portion-to-be-urged and said curved portion.

3. An image forming apparatus according to claim 1, wherein in a case that said rotatable member is positioned at the open position, said urging portion is positioned further toward a rear surface of said apparatus main assembly with respect to the longitudinal direction than said portion-to-be-urged and said curved portion.

4. An image forming apparatus according to claim 1, wherein, in a case that said rotatable member is positioned at the open position, said urging portion is positioned further toward a front side of said apparatus main assembly with respect to the longitudinal direction than said portion-to-be-urged, and said urging portion is positioned closer to a rotational axis of said photosensitive drum than said portion-to-be-urged.

5. An image forming apparatus according to claim 1, wherein said portion-to-be-urged is a surface perpendicular to the longitudinal direction.

6. An image forming apparatus according to claim 1, wherein in a case that said rotatable member is positioned at the open position, said urging portion is positioned further toward a rear side of said apparatus main assembly with respect to the longitudinal direction than a rotational axis of said rotational axis of said rotatable member, and wherein in a case that said rotatable member is positioned at the closed position, said urging portion is positioned further toward a front side of said apparatus main assembly with respect to the longitudinal direction than the rotational axis of said rotatable member.

7. An image forming apparatus according to claim 1, wherein a position of said urging portion when said rotatable member is positioned at the closed position is closer to a rotational axis of said photosensitive drum than a position of said urging portion when said rotatable member is positioned at the open position.

8. An image forming apparatus according to claim 1, wherein said position is a cylinder-shaped projection extending in the rotational axis direction.

9. An image forming apparatus according to claim 1, wherein said curved portion and said portion-to-be-urged are a continuous surface.

10. An image forming apparatus according to claim 1, wherein said rotatable member and said urging portion are an integrally molded product.

11. An image forming apparatus comprising:

a drum unit which rotatably supports a photosensitive drum and which is mountable in and dismountable from an apparatus main assembly by inserting and extracting said drum unit from a side surface of said apparatus main assembly on a front side;

an optical print head for exposing said photosensitive drum to light;

a rotatable member which rotates about a rotational axis, as a rotation center, passing through a lower side of a rotational axis of said photosensitive drum with respect to a vertical direction and extending in a direction perpendicular to both of a longitudinal direction of said optical print head and the vertical direction, the rotatable member being movable between a closed position where a movement path of said drum unit when said drum unit is inserted in and extracted from said apparatus main assembly is closed and an open position where the movement path opens;

an urging portion provided on said rotatable member at a lower side of said rotational axis with respect to the vertical direction and moving together with said rotating rotatable member around said rotational axis; and a moving mechanism for urging said optical print head toward said drum unit by moving said optical print head from a retracted position where said optical print head is retracted from said drum unit to permit insertion and extraction of said drum unit toward said drum unit for exposing said photosensitive drum to light, said moving mechanism including:

(i) a slidable portion which includes a portion-to-be-urged positioned on a movement locus of said urging portion moving around the rotational axis of said rotatable member with rotation of said rotatable member from the open position to the closed position and urged by said moving urging member, and a curved portion provided adjacently to said portion-to-be-urged on a side downstream of said portion-to-be-urged with respect to the movement direction on the movement locus and forming a shape along the movement locus, and said slidable portion sliding in one direction with respect to the longitudinal direction relative to said apparatus main assembly;

(ii) a spring provided in said optical print head and imparting, to said optical print head, an urging force for urging said optical print head toward said drum unit and (ii) a link portion rotatably connected to said optical print head on one end side and rotatably connected to said slidable portion on the other end side, wherein said link portion rotates with the slide of said slidable portion and deforms said spring in interrelation with the rotation, wherein in order that a rotation amount of said first portion relative to a rotation amount of said rotatable member when said urging portion urges said curved portion is less than a rotation amount of said link portion relative to a rotation amount of said rotatable member when said urging portion urges said portion-to-be-urged, and wherein an amount of the slide of said slidable portion per unit rotation amount of said rotatable member when said urging portion urges said curved portion is less than an amount of the slide of said slidable portion per unit rotation amount of said rotatable member when said urging portion urges said portion-to-be-urged.

12. An image forming apparatus according to claim 11, wherein, in a case that said optical print head is positioned at the retracted position, said urging portion is positioned further toward a rear side of said apparatus main assembly with respect to the longitudinal direction than said portion-to-be-urged and said curved portion.

13. An image forming apparatus according to claim 11, wherein, in a case that said rotatable member is positioned at the open position, said urging portion is positioned further toward a rear surface of said apparatus main assembly with respect to the longitudinal direction than said portion-to-be-urged and said curved portion.

14. An image forming apparatus according to claim 11, wherein, in a case that said rotatable member is positioned at the open position, said urging portion is positioned further toward a front side of said apparatus main assembly with respect to the longitudinal direction than said portion-to-be-urged, and said urging portion is positioned closer to a rotational axis of said photosensitive drum with respect to the longitudinal direction than said portion-to-be-urged.

15. An image forming apparatus according to claim 11, wherein said portion-to-be-urged is a surface perpendicular to a rotational axis of said photosensitive drum.

16. An image forming apparatus according to claim 11, wherein, in a case that said rotatable member is positioned at the open position, said urging portion is positioned further toward a rear side of said apparatus main assembly with respect to the longitudinal direction than a rotational axis of said rotational axis of said rotatable member, and wherein in a case that said rotatable member is positioned at the closed position, said urging portion is positioned further toward a front side of said apparatus main assembly with respect to the longitudinal direction than the rotational axis of said rotatable member.

17. An image forming apparatus according to claim 11, wherein a position of said urging portion when said rotatable member is positioned at the closed position is closer to a rotational axis of said photosensitive drum than a position of said urging portion when said rotatable member is positioned at the open position.

18. An image forming apparatus according to claim 11, wherein said position is a cylinder-shaped projection extending in the rotational axis direction.

19. An image forming apparatus according to claim 11, wherein said curved portion and said portion-to-be-urged are a continuous surface.

20. An image forming apparatus according to claim 11, wherein said rotatable member and said urging portion are an integrally molded product.

* * * * *